US010395820B2

(12) United States Patent
Fukushima et al.

(10) Patent No.: US 10,395,820 B2
(45) Date of Patent: Aug. 27, 2019

(54) COMMON MODE CHOKE COIL

(71) Applicant: TAIYO YUDEN CO., LTD., Tokyo (JP)

(72) Inventors: Akira Fukushima, Tokyo (JP); Kenichiro Nogi, Tokyo (JP); Masayuki Shimizu, Tokyo (JP); Akihiro Hoshino, Tokyo (JP)

(73) Assignee: TAIYO YUDEN CO., LTD., Tokyo (JP)

( * ) Notice: Subject to any disclaimer, the term of this patent is extended or adjusted under 35 U.S.C. 154(b) by 0 days.

(21) Appl. No.: 16/243,684

(22) Filed: Jan. 9, 2019

(65) Prior Publication Data

US 2019/0148059 A1 May 16, 2019

Related U.S. Application Data

(63) Continuation of application No. 16/046,290, filed on Jul. 26, 2018, now Pat. No. 10,210,991, which is a (Continued)

(30) Foreign Application Priority Data

Jun. 17, 2016 (JP) ..... 2016-121112

(51) Int. Cl.
*H01F 5/00* (2006.01)
*H01F 27/34* (2006.01)
(Continued)

(52) U.S. Cl.
CPC ..... *H01F 27/341* (2013.01); *H01F 5/00* (2013.01); *H01F 17/0013* (2013.01);
(Continued)

(58) Field of Classification Search
CPC ..... H01F 5/00; H01F 27/00–36
(Continued)

(56) References Cited

U.S. PATENT DOCUMENTS

2003/0052766 A1 3/2003 Tomohiro et al.
2006/0158301 A1 7/2006 Shinkai
(Continued)

FOREIGN PATENT DOCUMENTS

JP 2002-190410 7/2002
JP 2003-077727 3/2003
(Continued)

OTHER PUBLICATIONS

Notice of Allowance U.S. Appl. No. 15/462,184 dated Apr. 27, 2018.
(Continued)

*Primary Examiner* — Tuyen T Nguyen
(74) *Attorney, Agent, or Firm* — Pillsbury Winthrop Shaw Pittman, LLP

(57) ABSTRACT

A common mode choke coil according to one embodiment of the present invention includes a first coil conductor, a second coil conductor, and a third coil conductor. In the embodiment, the second coil conductor has a different shape than the first coil conductor and the third coil conductor. In the embodiment, the first coil conductor, the second coil conductor, and the third coil conductor extend parallel with each other in a first region in plan view as seen from an axial direction along the coil axis. In the embodiment, in the first region, when seen in a cross section cut along a plane including the coil axis, in an n-th turn, an arranging order of the first coil conductor, the second coil conductor, and the third coil conductor from an inner side in a radial direction thereof is inverted from that in an n+1th turn.

20 Claims, 18 Drawing Sheets

Related U.S. Application Data continuation of application No. 15/462,184, filed on Mar. 17, 2017, now Pat. No. 10,096,422.

(51) Int. Cl.

| | |
|---|---|
| ***H01F 27/29*** | (2006.01) |
| ***H01F 27/24*** | (2006.01) |
| ***H01F 27/28*** | (2006.01) |
| ***H01F 17/00*** | (2006.01) |

(52) U.S. Cl.

CPC ..... *H01F 27/24* (2013.01); *H01F 27/2804* (2013.01); *H01F 27/29* (2013.01); *H01F 2017/0066* (2013.01); *H01F 2017/0093* (2013.01); *H01F 2027/2809* (2013.01)

(58) Field of Classification Search

USPC ..... 336/65, 83, 180–184, 200, 232

See application file for complete search history.

(56) References Cited

U.S. PATENT DOCUMENTS

| | | | | |
|---|---|---|---|---|
| 2010/0157565 | A1 | 6/2010 | Yoshida et al. | |
| 2012/0306609 | A1 | 12/2012 | Kato | |
| 2014/0232501 | A1 | 8/2014 | Kato | |
| 2014/0266545 | A1 | 9/2014 | Shiroki et al. | |
| 2016/0372254 | A1* | 12/2016 | Harada | H01F 27/2804 |
| 2018/0336987 | A1* | 11/2018 | Kawashima | H01F 17/00 |

FOREIGN PATENT DOCUMENTS

| | | |
|---|---|---|
| JP | 2007-150209 | 6/2007 |
| JP | 2013-153184 | 8/2013 |
| JP | 2014-179570 | 9/2014 |
| JP | 2015-012167 | 1/2015 |
| JP | 2016157917 | 9/2016 |

OTHER PUBLICATIONS

Non-final Office Action issued in corresponding Korean Patent Application No. 10-2017-0027600 dated Mar. 19, 2018 with English language translation.

Notice of Allowance U.S. Appl. No. 16/046,290 dated Oct. 11, 2018.

Notification of Reasons for Refusal Japanese Patent Application No. 2016-121112 dated Aug. 21, 2018 with English translation.

MIPI Alliance, Inc., "Physical Layer Specifications", pp. 1-5, Mar. 15, 2017 http://mipi.org/specifications/physical-layer.

* cited by examiner

Related Art

Related Art

COMMON MODE CHOKE COIL

CROSS-REFERENCE TO RELATED APPLICATIONS

This application is a continuation of U.S. patent application Ser. No. 16/046,290 (filed on Jul. 26, 2018), which is a continuation of U.S. patent application Ser. No. 15/462,184 (filed on Mar. 17, 2017), now U.S. Pat. No. 10,096,422, which claims the benefit of priority from Japanese Patent Application Serial No. 2016-121112 (filed on Jun. 17, 2016), the contents of which are hereby incorporated by reference in their entirety.

TECHNICAL FIELD

The present disclosure relates to a common mode choke coil for eliminating common mode noise from a differential transmission circuit that transmits a differential signal More specifically, the present disclosure relates to a common mode choke coil suited for use in a differential transmission circuit that transmits a differential signal by using three signal lines per lane.

BACKGROUND

As a standard for transmitting data between a processor and peripheral equipment in a mobile apparatus, there is known the MIPI D-PHY (hereinafter, referred to simply as "D-PHY") specified by the MIPI (Mobile Industry Processor Interface) Alliance. In a currently prevailing mobile apparatus conforming to D-PHY, typically, four lanes of data signal lines and one lane of clock signal lines are used to differentially transmit a signal D-PHY stipulates that two signal lines per lane are used to transmit a differential signal, and thus there are used 10 signal lines in total D-PHY achieves data transmission of a maximum of 2.5 G bits/second.

In recent years, with an improvement in performance of peripheral equipment such as a camera, a display, and so on that are mounted in a mobile apparatus, there has been a demand for higher speed data transmission in the mobile apparatus. In response thereto, in 2011, the MIPI alliance developed M-PHY as a new physical layer standard. M-PHY can achieve data transmission of a maximum of 5.8 G bits/second per lane.

In order to conform to M-PHY, however, it is necessary that a physical layer designed to meet D-PHY be significantly modified. This necessity for significant modification from D-PHY has been an impediment to prevalence of M-PHY. With this as a background, in order to achieve higher speed data transmission while utilizing a D-PHY physical layer, C-PHY was developed in 2014. C-PHY stipulates that, while a physical layer configuration similar to that of a D-PHY physical layer is used, three signal lines per lane are used to differentially transmit a signal. As described above, without significantly modifying a D-PHY physical layer, C-PHY achieves higher speed data transmission by increasing the number of signal lines per lane from two to three.

The contents of the specifications of D-PHY, M-PHY, and C-PHY are available to the public on the web page of the MIPI Alliance (http://mipi.org/specifications/physical-layer).

In order to eliminate common mode noise from a differential transmission circuit from which a differential signal is transmitted, a common mode choke coil is used. The common mode choke coil includes a plurality of coil conductors, and these coils each function as an inductor that generates a large impedance with respect to common mode noise, and thus common mode noise can be eliminated from the differential transmission circuit. A conventional common mode choke coil is disclosed in, for example, Japanese Patent Application Publication No. 2003-77727, Japanese Patent Application Publication No. 2007-150209, Japanese Patent Application Publication No. 2013-153184, Japanese Patent Application Publication No. 2014-179570, Japanese Patent Application Publication No. 2015-012167, and so on.

In a common mode choke coil, it is desirable, while eliminating common mode noise, to prevent a signal waveform from being degraded. To this end, coils provided in the common mode choke coil are configured so that characteristic impedances thereof are matched to characteristic impedances of signal lines of a differential transmission line.

A common mode choke coil, in order to fulfill its function as an inductor, includes a plurality of coil conductors each formed in a spiral shape. For example, a common mode choke coil for a differential transmission circuit conforming to MIPI C-PHY includes three spiral-shaped coil conductors, which correspond to the number of signal lines per lane of said circuit. In such a common mode choke coil including three coil conductors, it is desirable that characteristic impedances (differential impedances) between said three coil conductors be all matched to characteristic impedances of said differential transmission circuit.

In order for characteristic impedances between the coil conductors to be matched to characteristic impedances of the differential transmission circuit, it is desirable that there be no deviation in the characteristic impedances between the coil conductors. To this end, it is desirable that there be also no deviation in stray capacities generated between the coil conductors. For this reason, normally, in order to eliminate a deviation in stray capacities between the coil conductors in each turn, the three coil conductors are wound so as to maintain an equal spacing from each other.

When, however, the three coil conductors are wound a plurality of turns while maintaining an equal spacing from each other, due to a stray capacity generated between the coil conductors respectively in turns adjacent to each other, there occurs a deviation in stray capacities between the coil conductors. For example, in a case of a common mode choke coil including three coil conductors that are first to third coil conductors, even when the coil conductors are disposed so that, in one turn, a stray capacity between the first coil conductor and the second coil conductor, a stray capacity between the second coil conductor and the third coil conductor, and a stray capacity between the third coil conductor and the first coil conductor are equal to each other, due to a stray capacity generated between them and the coil conductors in a turn adjacent to the one turn, there occurs a deviation in the stray capacities between the coil conductors. That is, since the coil conductors are wound at an equal spacing from each other, an outermost one of the coil conductors in one turn and an innermost one of the coil conductors in a turn outwardly adjacent to the one turn are different types of coil conductors, so that there occurs a relatively large stray capacity between these coil conductors. As described above, when coil conductors are wound at an equal spacing from each other, while it is possible to prevent occurrence of a deviation in stray capacities between the coil conductors in the same turn, due to a stray capacity generated between them and the coil conductors in a turn adjacent to the same turn, there occurs a deviation in the stray capacities between the coil conductors. Further, due to an influence of this stray capacity generated across the turns adjacent to each other, it becomes impossible for all characteristic impedances between the coil conductors to be matched to characteristic impedances of the differential transmission circuit.

SUMMARY

The present disclosure provides, in a common mode choke coil having three coil conductors, an improvement for reducing a deviation in stray capacities generated between the coil conductors. The present disclosure, in one aspect thereof, has as its object to provide a common mode choke coil that can suppress a deviation in stray capacities between coil conductors, which occurs due to a stray capacity generated between the coil conductors respectively in turns adjacent to each other. Other objects of the present invention will be made apparent through description of the specification as a whole.

A common mode choke coil according to one embodiment of the present invention includes a first coil conductor provided on a first coil forming surface in a first insulator and wound around a coil axis, a second coil conductor provided on a second coil forming surface in the first insulator and wound around the coil axis, and a third coil conductor provided on a third coil forming surface in the first insulator and wound around the coil axis. In said embodiment, the second coil conductor has a different shape than the first coil conductor and the third coil conductor, and the first coil conductor, the second coil conductor, and the third coil conductor extend parallel with each other in a first region in plan view as seen from an axial direction along the coil axis. In said embodiment, in the first region, when seen in a cross section cut along a plane including the coil axis, in an n-th turn, an arranging order of the first coil conductor, the second coil conductor, and the third coil conductor from an inner side in a radial direction thereof is inverted from that in an n+1th turn (where n is an arbitrary positive real number such that n+1 does not exceed any of the number of turns of the first coil conductor, the number of turns of the second coil conductor, and the number of turns of the third coil conductor). For example, when, in the n-th turn, the first coil conductor, the second coil conductor, and the third coil conductor are disposed in this order from the inner side, in the n+1th turn, these coil conductors are disposed in an order of the third coil conductor, the second coil conductor, and the first coil conductor from the inner side.

The coil conductors are disposed in this manner, and thus in turns adjacent to each other, the coil conductors of the same type can be disposed so that a distance between them is smallest among distances between the coil conductors. For example, in a case where, in the n-th turn, the first coil conductor, the second coil conductor, and the third coil conductor are disposed in this order from the inner side, and in the n+1th turn, the third coil conductor, the second coil conductor, and the first coil conductor are disposed in this order from the inner side, between the n-th turn and the n+1th turn, the third coil conductor in the n-th turn and the third coil conductor in the n+1th turn are disposed so that a distance between them is smallest among distances between the coil conductors. Accordingly, a distance between the third coil conductor in the n+1th turn and each of the first coil conductor and the second coil conductor in the n-th turn is longer than a distance between the third coil conductor in the n+1th turn and the third coil conductor in the n-th turn. On the other hand, in the conventional common mode choke coil in which the coil conductors are wound at an equal spacing from each other, for example, in a case where, in an n-th turn, the first coil conductor, the second coil conductor, and the third coil conductor are disposed in this order from an inner side, also in an n+1th turn, these coil conductors are disposed in an order of the first coil conductor, the second coil conductor, and the third coil conductor from the inner side. In this case, in the n-th turn and the n+1th turn adjacent to each other, the third coil conductor in the n-th turn and the first coil conductor in the n+1th turn are disposed so that a distance between them is smallest among distances between the coil conductors.

As is well known, the longer a distance between two conductors, the smaller a capacity generated between said conductors. According to the above-mentioned embodiment, in the n-th turn and the n+1th turn adjacent to each other, a distance between the coil conductors of the same type (for example, the third coil conductor in the n-th turn and the third coil conductor in the n+1th turn) can be made shorter than a distance between the coil conductors of different types. Thus, according to the above-mentioned embodiment, compared with the conventional common mode choke coil in which, in turns adjacent to each other, the coil conductors of different types are disposed at a shortest distance from each other, it is possible to suppress a deviation in stray capacities between the coil conductors, which occurs due to a stray capacity generated between the coil conductors respectively in turns adjacent to each other. In this specification, unless a different description is made or unless contextually required to interpret otherwise, a "stray capacity" refers to a stray capacity that is generated between a coil conductor of a common mode choke coil and another conductor thereof and exerts an influence on characteristic impedances between the coil conductors of the common mode choke coil.

In another embodiment of the present invention, in the first region, a line segment of the first coil conductor in the n+1th turn, a line segment of the second coil conductor in the n+1th turn, and a line segment of the third coil conductor in the n+1th turn are provided so as to be plane-symmetrical to a line segment of the first coil conductor in the n-th turn, a line segment of the second coil conductor in the n-th turn, and a line segment of the third coil conductor in the n-th turn, respectively, with respect to a virtual plane passing through a midpoint between the line segment of the first coil conductor in the n-th turn and the line segment thereof in the n+1th turn and extending parallel with the coil axis.

According to said embodiment, in the n-th turn and the n+1th turn adjacent to each other, a distance between the coil conductors of the same type can be made shorter than a distance between the coil conductors of different types. Thus, compared with the conventional common mode choke coil in which, in turns adjacent to each other, the coil conductors of different types are disposed at a shortest distance from each other, it is possible to suppress a deviation in stray capacities between the coil conductors, which occurs due to a stray capacity generated between the coil conductors respectively in the turns adjacent to each other.

ADVANTAGES

According to the disclosure of this specification, in a common mode choke coil having three coil conductors, a deviation in stray capacities between the coil conductors can be reduced.

DESCRIPTION OF THE PREFERRED EMBODIMENTS

Figure 1:
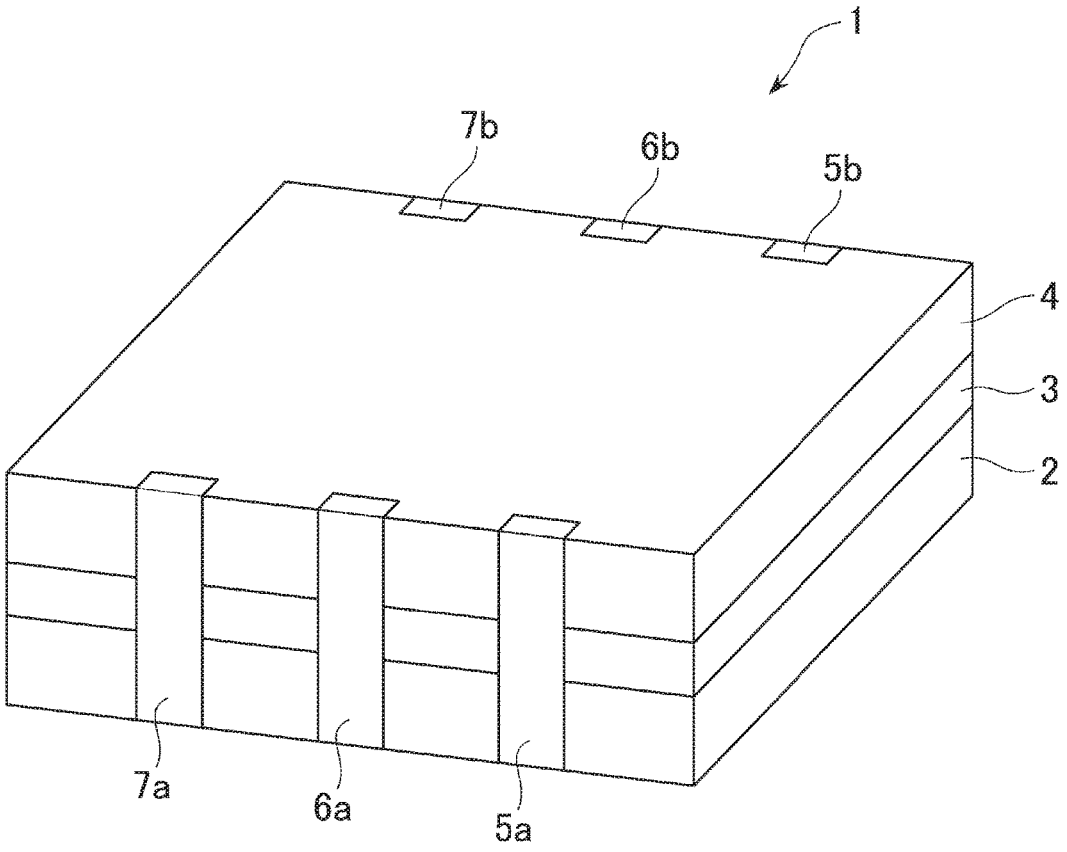
FIG. 1 is a perspective view of a common mode choke coil according to one embodiment of the present invention.

By referring to the appended drawings as appropriate, the following describes various embodiments of the present invention. Constituent components common to a plurality of drawings are denoted by the same reference characters throughout said plurality of drawings. It is to be noted that, for the sake of convenience of explanation, the drawings are not necessarily depicted to scale.

FIG. 1 is a perspective view of a common mode choke coil according to one embodiment of the present invention. A common mode choke coil 1 shown in FIG. 1 may include a lower dummy insulation layer 2, a laminated body 3, an upper dummy insulation layer 4, and terminal electrodes 5*a*, 5*b*, 6*a*, 6*b*, 7*a*, and 7*b*. The dummy insulation layers 2 and 4 may be each formed of a magnetic material or a non-magnetic material and have an excellent insulation property. In a case where the dummy insulation layers 2 and 4 are each formed of a magnetic material, Ni-Zn-Cu-based ferrite can be used as said magnetic material. The common mode choke coil 1 may have dimensions of, for example, 25 mm×1.0 mm×0.5 mm.

The terminal electrodes 5*a*, 5*b*, 6*a*, 6*b*, 7*a*, and 7*b* may be provided on side surfaces of the laminated body 3 and extend, as shown in the figure, to an upper surface and a lower surface of the common mode choke coil 1. The terminal electrodes 5*a*, 5*b*, 6*a*, 6*b*, 7*a*, and 7*b* may be formed by, for example, applying an Ag paste to the side surfaces of the laminated body 3.

Next, with reference to FIG. 2 to FIG. 6, a description is given of the laminated body 3. As shown in the exploded perspective view of FIG. 2, in one embodiment of the present invention, the laminated body 3 may include a lower magnetic layer 8 and an upper magnetic layer 9, and between these magnetic layers, there may be stacked a first insulation layer 11, a first conductor layer 12, a second insulation layer 21, a second conductor layer 22, a third insulation layer 31, a third conductor layer 32, an extraction electrode insulation layer 41, an extraction conductor layer 42, and a cover insulation layer 51.

The lower magnetic layer 8 and the upper magnetic layer 9 may be each formed of a magnetic material. As the magnetic material, for example, Ni-Zn-Cu-based ferrite can be used.

The first insulation layer 11, the second insulation layer 21, the third insulation layer 31, the extraction electrode insulation layer 41, and the cover insulation layer 51 may be each formed of a non-magnetic material and have an excellent insulation property. As the non-magnetic material, for example, various types of resin materials (for example, a polyimide resin, an epoxy resin, and resin materials other than these), various types of dielectric ceramics (borosilicate glass, a mixture of borosilicate glass and crystalline silica, and dielectric ceramics other than these), and various types of non-magnetic ferrite (for example, Zn-Cu-based ferrite) can be used. In one embodiment of the present invention, as the non-magnetic material, for example, various types of ferrite materials having a dielectric constant of not more than 20, various types of resin materials or various types of dielectric ceramic materials having a dielectric constant of not more than 10, or various types of dielectric ceramic materials having a dielectric constant of not more than 6 may be used.

The first conductor layer 12, the second conductor layer 22, the third conductor layer 32, and the extraction conductor layer 42 may be each formed of a metal material such as Ag or the like. It may be desirable that the metal material be excellent in conductivity and workability. As the metal material, besides Ag, Cu or Al can be used.

The above-mentioned materials of the magnetic layers, the insulation layers, and the conductor layers may be illustrative only, and depending on required performance and required characteristics of the common mode choke coil 1, besides the materials explicitly described in this specification, various other materials can also be used.

In the laminated body 3 shown in the figure, on the lower magnetic layer 8, the first insulation layer 11 may be formed. In this specification, when an up-and-down direction is referred to, unless contextually interpreted otherwise, "up" may refer to an upward direction in FIG. 2 and "down" may refer to a downward direction in FIG. 2.

Figure 3:
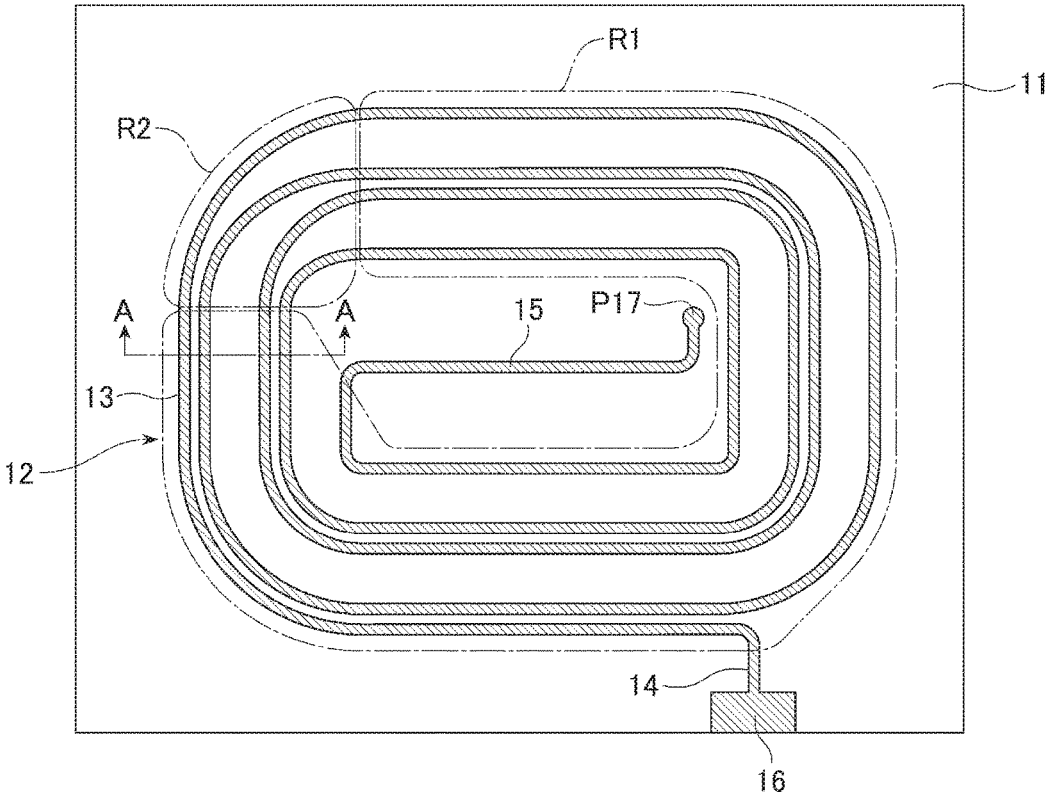
FIG. 3 is a plan view showing a first insulation layer and a first conductor layer formed on said first insulation layer, which are provided in the common mode choke coil in FIG. 2.

On the first insulation layer 11, the first conductor layer 12 may be formed. As shown in FIG. 3, the first conductor layer 12 may include a coil conductor 13, an extraction conductor 14 whose one end is connected to an outer side end portion of the coil conductor 13, an extraction conductor 15 whose one end is connected to an inner side end portion of the coil conductor 13, and an extraction electrode 16 connected to the extraction conductor 14. The extraction electrode 16 may be electrically connected to the terminal electrode 5*a*. The coil conductor 13 may be wound a plurality of turns around a coil axis CA, thus having a spiral shape. The coil axis CA may be a virtual axis extending in a stacking direction of the laminated body 3 (namely, the up-and-down direction of the common mode choke coil 1). In one embodiment, the coil axis CA may extend in a direction substantially orthogonal to the first insulation layer 11.

Figure 4:
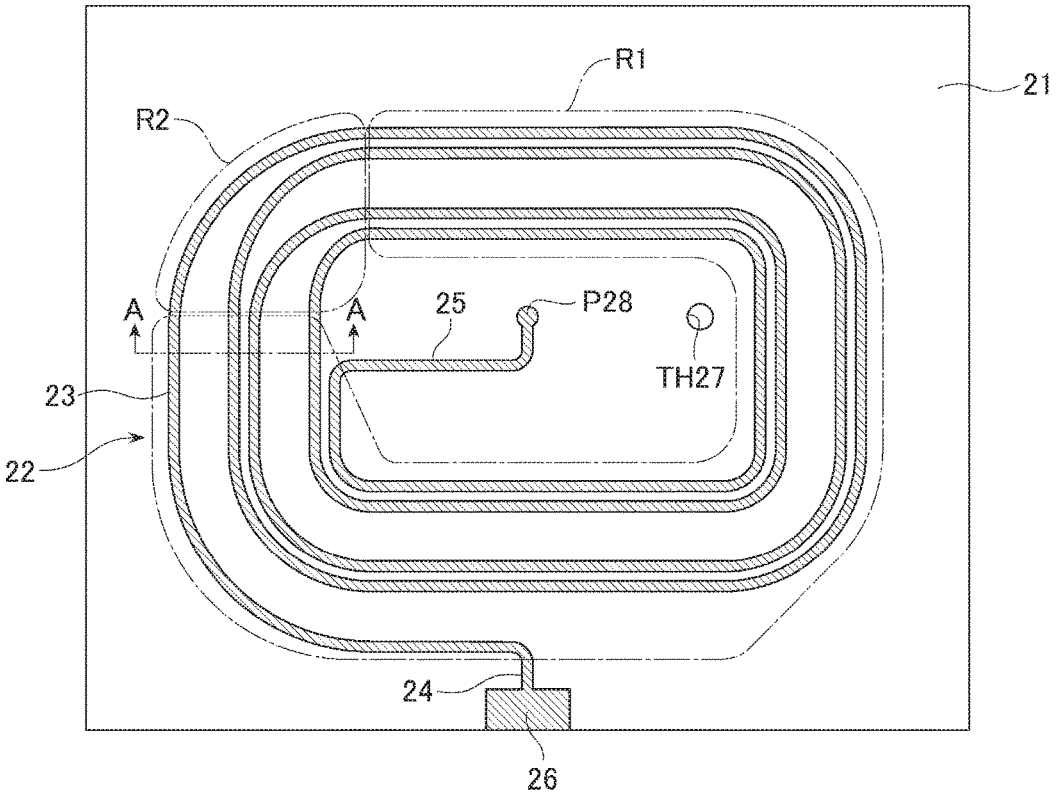
FIG. 4 is a plan view showing a second insulation layer and a second conductor layer formed on said second insulation layer, which are provided in the common mode choke coil in FIG. 2.

On the first conductor layer 12, the second insulation layer 21 may be formed. On said second insulation layer 21, the second conductor layer 22 may be formed. As shown in FIG. 4, the second conductor layer 22 may include a spiral-shaped coil conductor 23, an extraction conductor 24 whose one end is connected to an outer side end portion of the coil conductor 23, an extraction conductor 25 whose one end is connected to an inner side end portion of the coil conductor 23, and an extraction electrode 26 connected to the extraction conductor 24. The extraction electrode 26 may be electrically connected to the terminal electrode 6*a*. The coil conductor 23 may be wound a plurality of turns around the coil axis CA, thus having a spiral shape.

Figure 5:
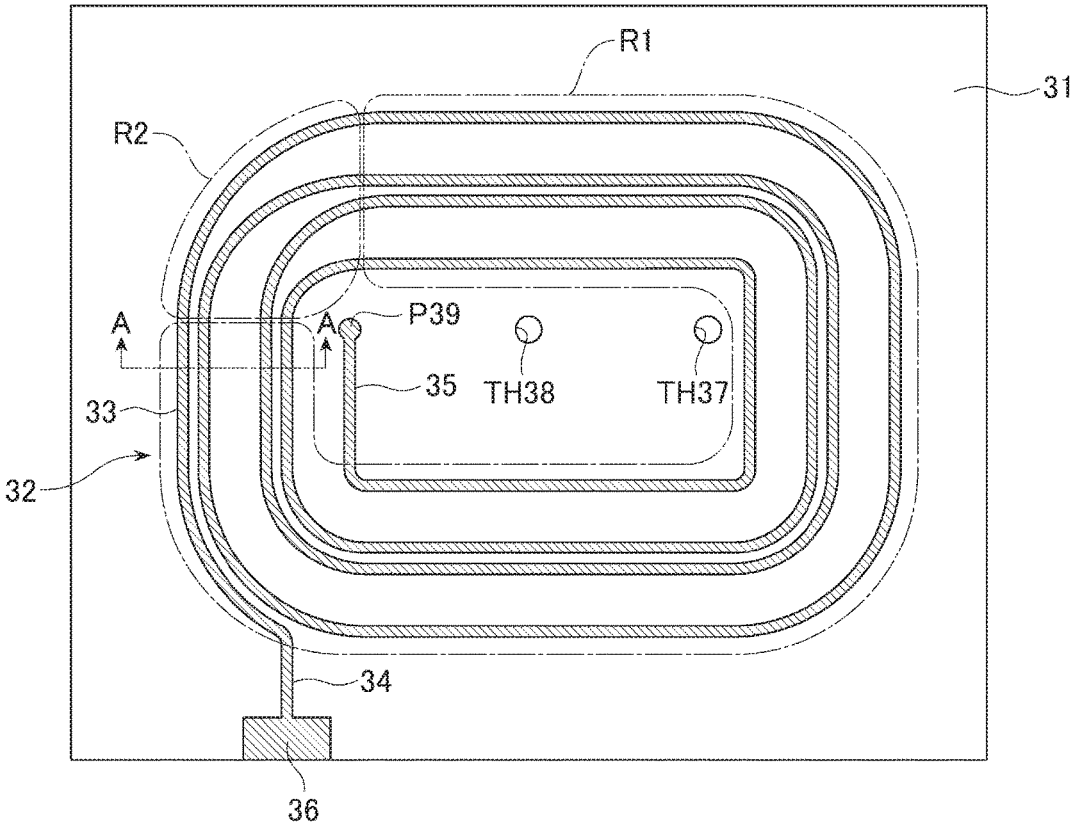
FIG. 5 is a plan view showing a third insulation layer and a third conductor layer formed on said third insulation layer, which are provided in the common mode choke coil in FIG. 2.
Figure 6:
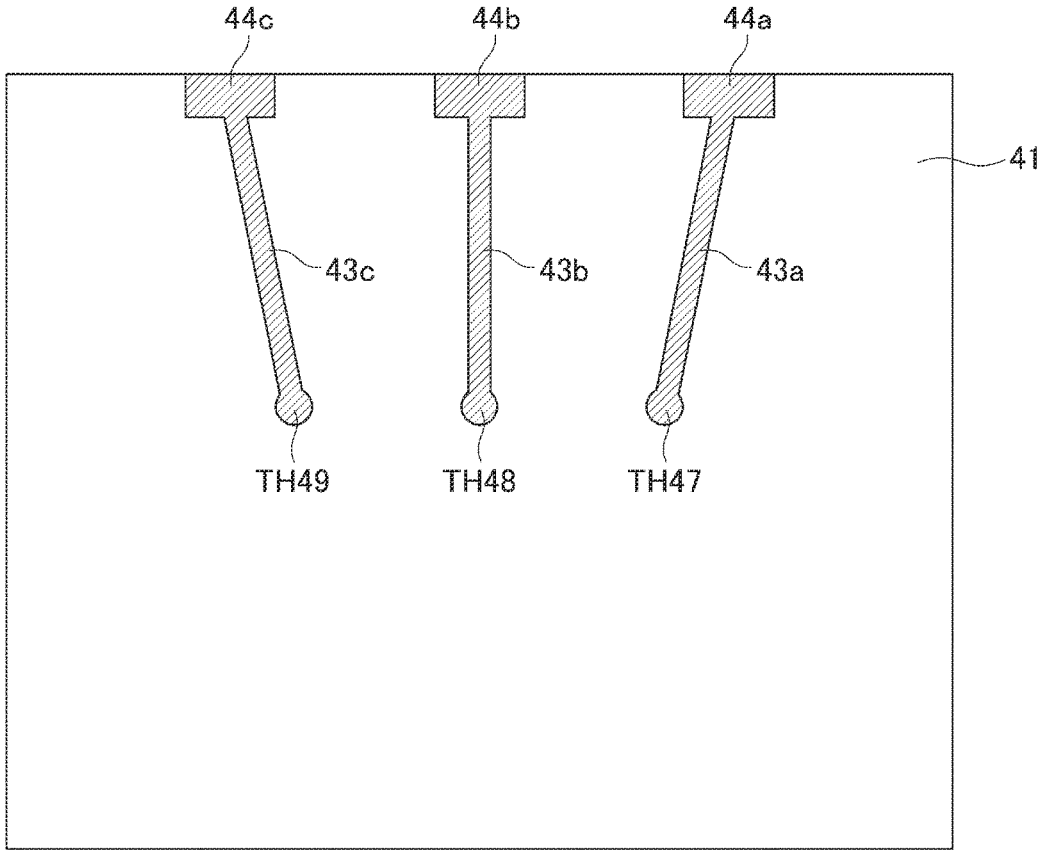
FIG. 6 is a plan view showing a fourth insulation layer and a fourth conductor layer formed on said fourth insulation layer, which are provided in the common mode choke coil in FIG. 2.

On the second conductor layer 22, the third insulation layer 31 may be formed. On said third insulation layer 31, the third conductor layer 32 may be formed. As shown in FIG. 5, the third conductor layer 32 may include a spiral-shaped coil conductor 33, an extraction conductor 34 whose one end is connected to an outer side end portion of the coil conductor 33, an extraction conductor 35 whose one end is connected to an inner side end portion of the coil conductor 33, and an extraction electrode 36 connected to the extraction conductor 34. The extraction electrode 36 may be electrically connected to the terminal electrode 7*a*. The coil conductor 33 may be wound a plurality of turns around the coil axis CA, thus having a spiral shape.

On the third conductor layer 32, the extraction electrode insulation layer 41 may be formed. On said extraction electrode insulation layer 41, the extraction conductor layer 42 may be formed. The extraction conductor layer 42 may include an extraction conductor 43*a*, an extraction conductor 43*b*, an extraction conductor 43*c*, an extraction electrode 44*a* connected to the extraction conductor 43*a*, an extraction electrode 44*b* connected to the extraction conductor 43*b*, and an extraction electrode 44*c* connected to the extraction conductor 43*c*. The extraction electrode 44*a* may be electrically connected to the terminal electrode 5*b*. The extraction electrode 44*b* may be electrically connected to the terminal electrode 6*b*. The extraction electrode 44*c* may be electrically connected to the terminal electrode 7*b*.

In order to connect an end portion of the extraction conductor 15 of the first conductor layer 12 to an end portion of the extraction conductor 43*a*, a pad P17 may be formed on the first insulation layer 11, a through hole TH27 may be formed through the second insulation layer 21, a through hole TH37 may be formed through the third insulation layer 31, and a through hole TH47 may be formed through the extraction electrode insulation layer 41. The through holes TH27, TH37, and TH47 may be formed by embedding a metal material such as Ag or the like in penetration holes formed through the second insulation layer 21, the third insulation layer 31, and the extraction electrode insulation layer 41, respectively. In order to connect an end portion of the extraction conductor 25 of the second conductor layer 22 to an end portion of the extraction conductor 43*b*, a pad P28 may be formed on the second insulation layer 21, a through hole TH38 may be formed through the third insulation layer 31, and a through hole TH48 may be formed through the extraction electrode insulation layer 41. In order to connect an end portion of the extraction conductor 35 of the third conductor layer 32 to an end portion of the extraction conductor 43*c*, a pad P39 may be formed on the third insulation layer 31, and a through hole TH49 may be formed through the extraction electrode insulation layer 41. These pads and through holes may be formed similarly to the pad P17 and the through hole TH27, respectively.

By the above-mentioned configuration and disposition, in the common mode choke coil 1, three coils may be provided between the terminal electrodes 5*a*, 6*a*, and 7*a* and the terminal electrodes 5*b*, 6*b*, and 7*b*. That is, an outer side end of the coil conductor 13 may be electrically connected to the terminal electrode 5*a* via the extraction conductor 14 and the extraction electrode 16, and an inner side end of the coil conductor 13 may be electrically connected to the terminal electrode 5*b* via the extraction conductor 15, the pad P17, the through hole TH27, the through hole TH37, the through hole TH47, the extraction conductor 43*a*, and the extraction electrode 44*a*, so that a first coil including the coil conductor 13 may be configured between the terminal electrode 5*a* and the terminal electrode 5*b*. Furthermore, an outer side end of the coil conductor 23 may be electrically connected to the terminal electrode 6*a* via the extraction conductor 24 and the extraction electrode 26, and an inner side end of the coil conductor 23 may be electrically connected to the terminal electrode 6*b* via the extraction conductor 25, the pad P28, the through hole TH38, the through hole TH48, the extraction conductor 43*b*, and the extraction electrode 44*b*, so that a second coil including the coil conductor 23 may be configured between the terminal electrode 6*a* and the terminal electrode 6*b*. Moreover, an outer side end of the coil conductor 33 may be electrically connected to the terminal electrode 7*a* via the extraction conductor 34 and the extraction electrode 36, and an inner side end of the coil conductor 33 may be electrically connected to the terminal electrode 7*b* via the extraction conductor 35, the pad P39, the through hole TH49, the extraction conductor 43*c*, and the extraction electrode 44*c*, so that a third coil including the coil conductor 33 may be configured between the terminal electrode 7*a* and the terminal electrode 7*b*. These three coils may be each a planar coil formed on a plane. These three coils may be connected to, for example, three signal lines in a differential transmission circuit conforming to C-PHY developed by the MIPI Alliance.

Next, a description is given of one example of a method for manufacturing the common mode choke coil 1. First, magnetic sheets used to form the lower dummy insulation layer 2, the upper dummy insulation layer 4, the lower magnetic layer 8, and the upper magnetic layer 9, respectively, may be fabricated. In order to fabricate the magnetic sheets, slurry may be made by adding a butyral resin and a solvent to a calcined and ground Ni-Zn-Cu-based ferrite fine powder made mainly of FeO2, CuO, ZnO, and NiO. This slurry may be applied in a uniform thickness by using a doctor blade. The slurry thus applied may be dried, and the slurry after being dried may be cut into a predetermined size, so that the magnetic sheets used to form the lower dummy insulation layer 2, the upper dummy insulation layer 4, the lower magnetic layer 8, and the upper magnetic layer 9, respectively, may be obtained.

Next, non-magnetic sheets used to form the first insulation layer 11, the second insulation layer 21, the third insulation layer 31, the extraction electrode insulation layer 41, and the cover insulation layer 51, respectively, may be fabricated. In order to fabricate the non-magnetic sheets, slurry may be made by adding a butyral resin and a solvent to a calcined and ground Zn-Cu-based ferrite fine powder made mainly of FeO2, CuO, and ZnO. This slurry may be applied in a uniform thickness by using a doctor blade. The slurry thus applied may be dried, and the slurry after being dried may be cut into a predetermined size, so that the non-magnetic sheets used to form the first insulation layer 11, the second insulation layer 21, the third insulation layer 31, the extraction electrode insulation layer 41, and the cover insulation layer 51, respectively, may be obtained. Through the non-magnetic sheets, penetration holes may be formed at positions corresponding to the through holes, respectively. These penetration holes may be formed by, for example, punching holes through the non-magnetic sheets or by perforating the magnetic sheets with holes by laser irradiation.

By using a screen printing plate, an Ag paste may be printed on one of the non-magnetic sheets thus fabricated, which corresponds to the first insulation layer 11, thereby forming a pattern corresponding to the first conductor layer 12. Similarly, by using the screen printing plate, an Ag paste may be printed on one of the non-magnetic sheets, which corresponds to the second insulation layer 21, thereby forming a pattern corresponding the second conductor layer 22. By using the screen printing plate, an Ag paste may be printed on one of the non-magnetic sheets, which corresponds to the third insulation layer 31, thereby forming a pattern corresponding the third conductor layer 32. By using the screen printing plate, an Ag paste may be printed on one of the non-magnetic sheets, which corresponds to the extraction electrode insulation layer 41, thereby forming a pattern corresponding the extraction conductor layer 42. The pads may also be formed together with the patterns corresponding to the first conductor layer 12 or the second conductor layer 22. Furthermore, Ag may be embedded in the penetration holes formed through the non-magnetic sheets. The first conductor layer 12, the second conductor layer 22, the third conductor layer 32, and the extraction conductor layer 42 may be formed by various known methods. For example, vapor deposition using a mask, a thin film process such as sputtering or the like, plating of a seed layer formed by the thin film process or the like, a microtransfer process such as nano-imprinting, or the like can be used to form these conductive layers. In a conductor fabricated by printing or the microtransfer process, a height of said conductor with respect to a width thereof (an aspect ratio) can hardly be increased and thus may normally be lower than 1, while in a conductor fabricated by the thin film process or plating, the aspect ratio can be easily adjusted and increased even to, for example, not less than 1. Accordingly, by using the thin film process or plating to form respective conductor patterns of the first conductor layer 12, the second conductor layer 22, the third conductor layer 32, and the extraction conductor layer 42, designing of a stray capacity may be facilitated.

Figure 2:
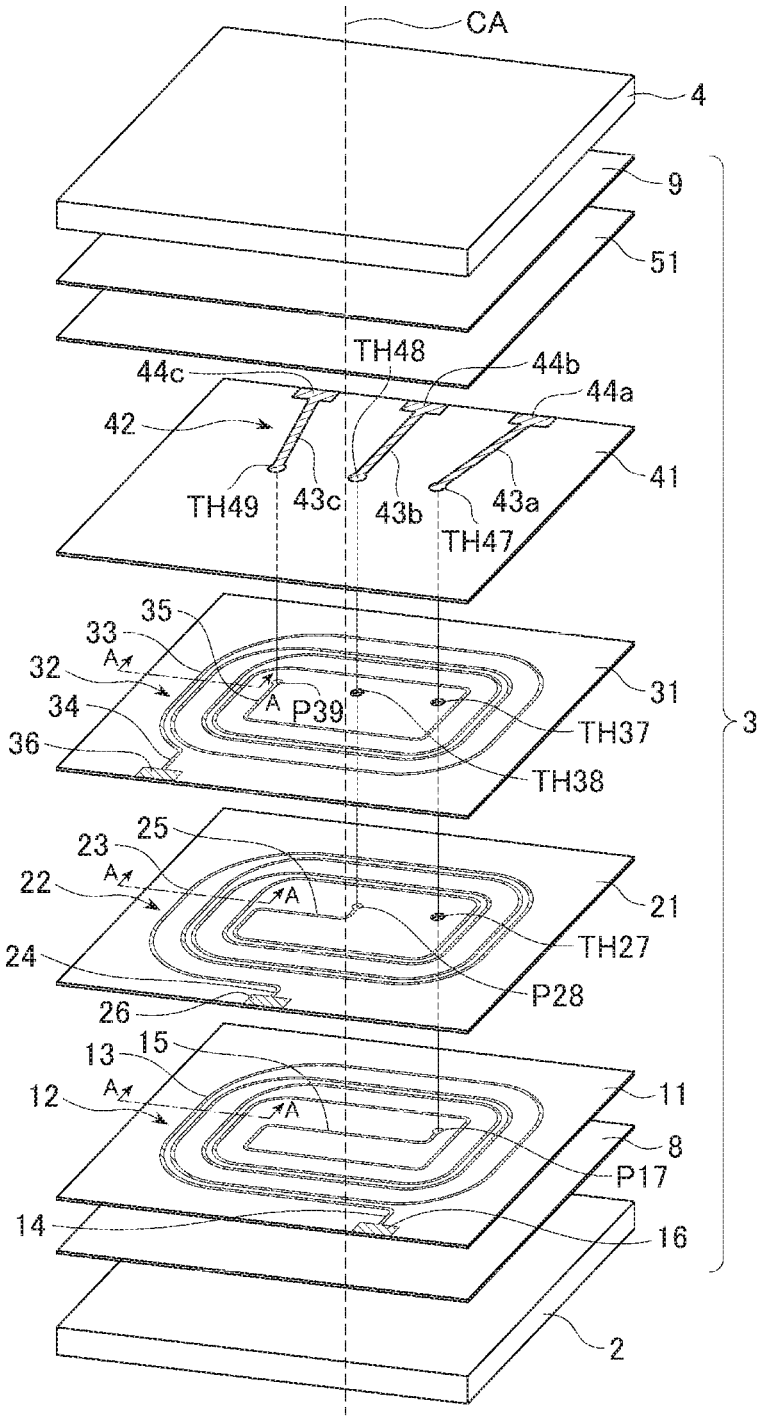
FIG. 2 is an exploded perspective view of the common mode choke coil according to one embodiment of the present invention.

Next, the plurality of magnetic sheets and the plurality of non-magnetic sheets fabricated in the above-mentioned manner may be stacked in an order shown in FIG. 2 so that the printed conductor patterns are brought into conduction via the through holes. The plurality of magnetic sheets and the plurality of non-magnetic sheets thus stacked may be press-bonded. A laminated body resulting from the press-bonding may be cut into units of a predetermined size, and each of the units thus obtained by cutting the laminated body may be calcined at a predetermined temperature to form a laminated chip. Next, an Ag paste may be applied and baked on side surfaces of the laminated chip thus formed, so that the terminal electrodes 5*a*, 5*b*, 6*a*, 6*b*, 7*a*, and 7*b* may be formed thereon. In a case, however, where any of various types of resin materials is used as a material, without performing calcination, an Ag conductive resin paste may be applied on the side surfaces of the laminated chip thus formed and heated to be cured, so that the terminal electrodes 5*a*, 5*b*, 6*a*, 6*b*, 7*a*, and 7*b* may be formed thereon. The common mode coke coil 1 may be formed in this manner. The above-mentioned method for manufacturing the common mode choke coil 1 may be merely one example, and a method for fabricating a common mode choke coil to which the present invention is applicable may not be limited thereto.

Figure 7:
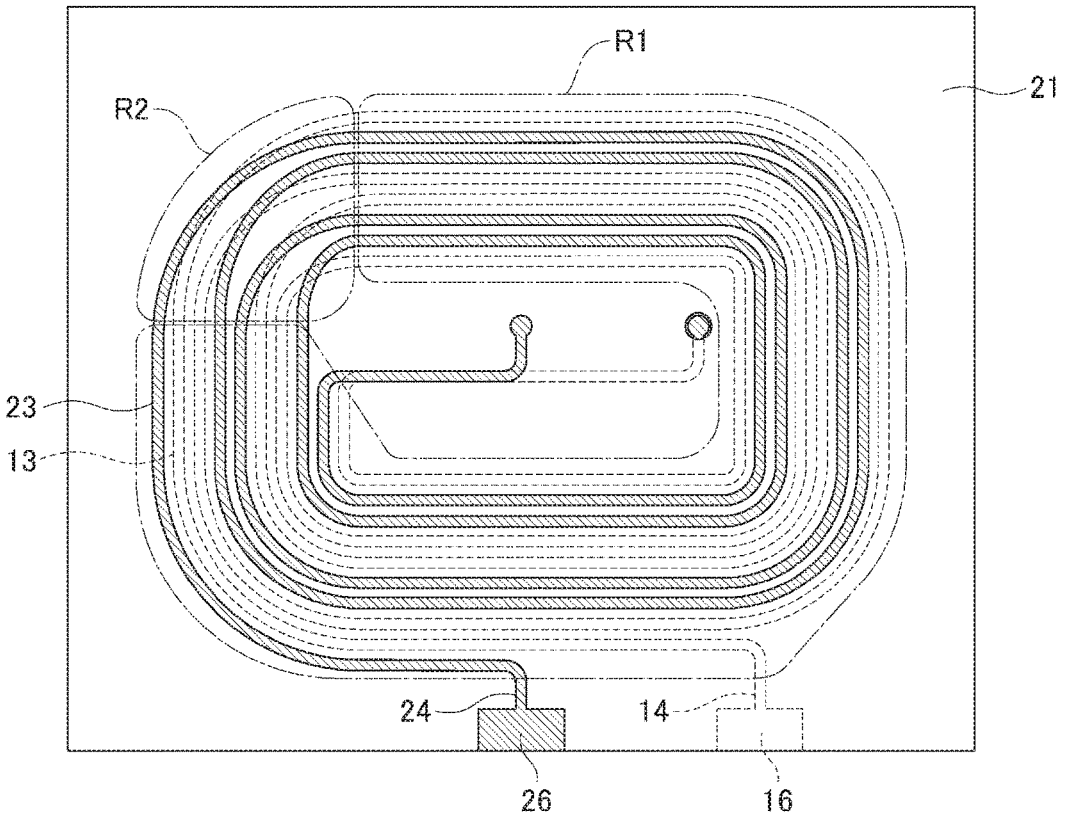
FIG. 7 is a schematic plan view showing a state where a second conductor layer 22 in FIG. 4 is superposed on a first conductor layer 12 in FIG. 3.

With reference again to FIG. 3 to FIG. 5 and also to FIG. 7, a further description is given of disposition, in plan view, of the coil conductor 13, the coil conductor 23, and the coil conductor 33. As shown in FIG. 3, the coil conductor 13 may be formed of a spiral-shaped line segment provided between an end portion of the extraction conductor 14 and the end portion of the extraction conductor 15. As shown in FIG. 4, the coil conductor 23 may be formed of a spiral-shaped line segment provided between an end portion of the extraction conductor 24 and the end portion of the extraction conductor 25. As shown in FIG. 5, the coil conductor 33 may be formed of a spiral-shaped line segment provided between an end portion of the extraction conductor 34 and the end portion of the extraction conductor 35. In one embodiment of the present invention, the coil conductor 33 may be formed in the same shape in plan view as that of the coil conductor 13. Furthermore, in one embodiment of the present invention, the coil conductor 33 may be disposed at such a position as to overlap, in plan view, with the coil conductor 13.

FIG. 7 is a schematic plan view showing, in order to further describe disposition of the coil conductor 13 and the coil conductor 23, a state where the second conductor layer 22 is superposed on the first conductor layer 12. In FIG. 7, the coil conductor 13 is shown by a broken line, and the coil conductor 23 is shown by a solid line. As shown in FIG. 7, when the common mode choke coil 1 is seen in plan view (that is, when the common mode choke coil 1 is seen from an axial direction along the coil axis CA), in a first region R1, the line segment of the coil conductor 13 and the line segment of the coil conductor 23 may be configured and disposed so as to extend parallel with each other. On the other hand, when the common mode choke coil 1 is seen in plan view, in a second region R2, the line segment of the coil conductor 13 and the line segment of the coil conductor 23 may be configured and disposed so as to cross over each other.

As shown in FIG. 7, in a first turn of the coil conductor 13 and the coil conductor 23 (for the sake of convenience, the number of turns of the coil conductors is counted from an outer side), in the first region R1 up to a point before entering the second region R2, the coil conductor 23 may be disposed, in plan view, on an outer side relative to the coil conductor 13. In the second region R2, parallelism in disposition between the coil conductor 13 and the coil conductor 23 may collapse, and the coil conductor 13 and the coil conductor 23 may cross over each other, with the coil conductor 23 turning inwardly and the coil conductor 13 turning outwardly. Back in the first region R1 past the second region R2, the coil conductor 13 may extend in a lane on an outer side relative to the coil conductor 23 parallel with the coil conductor 23. Throughout the first region R1, while maintaining this disposition, the coil conductor 13 and the coil conductor 23 may extend in a circumferential direction. In a second turn, in the second region R2, conversely to the case of the first turn, the coil conductor 13 and the coil conductor 23 may cross over each other, with the coil conductor 13 turning inwardly and the coil conductor 23 turning outwardly. In this second turn, back in the first region R1 past the second region R2, the coil conductor 23 may extend in a lane on an outer side relative to the coil conductor 13 parallel with the coil conductor 13. Throughout the first region R1, while maintaining this disposition, the coil conductor 13 and the coil conductor 23 may extend in the circumferential direction into a third turn. In a similar manner, the coil conductor 13 and the coil conductor 23 may continue to extend in the circumferential direction to be connected to the extraction conductor 15 and the extraction conductor 25, respectively. As mentioned above, in one embodiment of the present invention, the coil conductor 33 may be disposed so as to overlap, in plan view, with the coil conductor 13. In this case, the same description as that of the coil conductor 13 given with reference to FIG. 7 may equally apply also to the coil conductor 33. For example, in a first turn, up to a point before entering the second region R2, the coil conductor 33 may be disposed, in plan view, on an inner side relative to the coil conductor 23, while in the first turn, in a region past the second region R2, the coil conductor 33 may pass through a lane on an outer side relative to the coil conductor 23. This disposition may be maintained up to a point of passing through the second region R2 again in a second turn.

It is to be noted that, while the coil conductor 13, the coil conductor 23, and the coil conductor 33 may cross over each other in plan view, these coil conductors may be electrically insulated from each other. That is, also in the second region R2, the line segment of the coil conductor 13 and the line segment of the coil conductor 23 may be disposed apart from each other in the up-and-down direction, and thus the line segment of the coil conductor 13 and the coil conductor 23 may be electrically insulated from each other. When the common mode choke coil 1 is seen in a cross section cut along a plane including the coil axis CA, in the region R2, the line segment of the coil conductor 13 and the coil conductor 23 may be disposed apart from each other.

While in the embodiment shown in FIG. 7, a periphery of an upper left corner of the coil conductor 13, the coil conductor 23, and the coil conductor 33 is defined as the second region, the second region can be provided at any arbitrary position on a turn of the coils. For example, it may also be possible that a periphery of an upper right corner of the coil conductors is defined as the second region or an area other than corners is defined as the second region. It may be desirable that the respective line segments of the coil conductor 13, the coil conductor 23, and the coil conductor 33 have a length in the first region R1 longer than that in the second region R2. By setting the respective line segments of the coil conductors to be longer in the first region R1, a section in which the coil conductors are disposed parallel with each other can be increased. Thus, a balance of stray capacities generated between the coil conductors in the same turn can be maintained.

Figure 8:
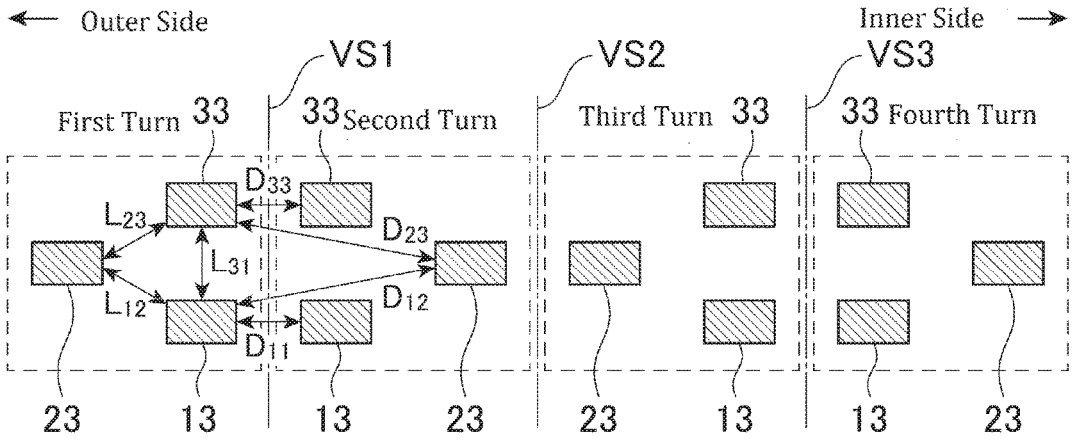
FIG. 8 is a sectional view schematically showing the first conductor layer, the second conductor layer, and the third conductor layer in a cross section of the common mode choke coil in FIG. 2 cut along an A-A line.

Next, with reference to FIG. 8, a further description is given of disposition of the coil conductor 13, the coil conductor 23, and the coil conductor 33. FIG. 8 is a sectional view schematically showing a cross section (for example, a cross section cut along an A-A line shown in FIG. 3 to FIG. 5) of the common mode choke coil 1 cut along a plane including the coil axis CA. In the embodiment shown in FIG. 8, the coil conductor 33 may be disposed at such a position as to overlap, in plan view, with the coil conductor 13.

As described with reference to FIG. 7, in the first turn, at a point before passing through the second region R2, the coil conductor 23 may be disposed on an outer side relative to the coil conductor 13 and the coil conductor 33. In the second turn, this disposition is reversed, i.e., the coil conductor 13 and the coil conductor 33 may be disposed on an outer side relative to the coil conductor 23. In other words, when seen in a cross section cut along a plane including the coil axis CA, in an n-th turn, an order of arranging the coil conductor 13, the coil conductor 23, and the coil conductor 33 from an inner side in a radial direction thereof may be inverted from that in an n+1th turn. For example, in the first turn, from the inner side in the radial direction, the coil conductors may be arranged in an order of the coil conductor 13 (or the coil conductor 33) and the coil conductor 23, while in the second turn, conversely thereto, the coil conductors may be arranged in an order of the coil conductor 23 and the coil conductor 13 (or the coil conductor 33). This disposition may be reversed in a third turn and further reversed therefrom in a fourth turn. As a result, as shown in FIG. 8, in the first turn and the third turn, the coil conductor 23 may be disposed on an outer side relative to the coil conductor 13 and the coil conductor 33, while in the second turn and the fourth turn, the coil conductor 23 may be disposed on an inner side relative to the coil conductor 13 and the coil conductor 33. In other words, in the first turn and the third turn, the coil conductor 13 and the coil conductor 33 may be disposed on an inner side relative to the coil conductor 23, while in the second turn and the fourth turn, the coil conductor 13 and the coil conductor 33 may be disposed on an outer side relative to the coil conductor 23. Thus, the disposition of the coil conductors in the first turn and the disposition of the coil conductors in the second turn may be plane-symmetrical to each other with respect to a virtual plane VS1 passing between the first turn and the second turn. That is, the line segment of the coil conductor 13 in the second turn may be disposed at a position plane-symmetrical to the line segment of the coil conductor 13 in the first turn with respect to the virtual plane VS1. A similar relationship may apply to the coil conductor 23 and the coil conductor 33. The virtual plane VS1 may be a virtual plane passing through a midpoint between the line segment of the coil conductor 23 in the first turn and the line segment thereof in the second turn and extending in a direction perpendicular to the insulation layers shown in FIG. 2 and so on. Similarly, the disposition of the coil conductors in the second turn and the disposition of the coil conductors in the third turn may be plane-symmetrical to each other with respect to a virtual plane VS2 passing between the second turn and the third turn, and the disposition of the coil conductors in the third turn and the disposition of the coil conductors in the fourth turn may be plane-symmetrical to each other with respect to a virtual plane VS3 passing between the third turn and the fourth turn. As is apparent to those skilled in the art, the foregoing description regarding a positional relationship between the coil conductors may similarly apply also to a case where the coil conductors are wound five turns or more. While FIG. 8 shows that, in plan view, the coil conductor 13 and the coil conductor 33 are disposed at the same position, as mentioned above, it may also be possible that, in plan view, the coil conductor 13 and the coil conductor 33 are disposed at different positions from each other. For example, it may also be possible that, in the first turn, the coil conductor 33 is disposed on an outer side relative to the coil conductor 13. In this example, in the first turn, an order of arranging the coil conductors from the inner side in the radial direction may be as follows: the coil conductor 13, the coil conductor 33, and the coil conductor 23. In this case, in the second turn, an order of arranging the coil conductors from the inner side in the radial direction may be inverted from that in the first turn and may therefore be as follows: the coil conductor 23, the coil conductor 33, and the coil conductor 13.

In one embodiment of the present invention, the coil conductor 13, the coil conductor 23, and the coil conductor 33 may be disposed in the first region R1 so that a stray capacity C12 generated between the coil conductor 13 and the coil conductor 23, a stray capacity C23 generated between the coil conductor 23 and the coil conductor 33, and a stray capacity C31 generated between the coil conductor 33 and the coil conductor 13 are equal to each other (i.e., an equation C12=C23=C31 is satisfied). By setting the stray capacities between the coil conductors in the same turn to be equal to each other as described above, a matched state of a characteristic impedance Z12 between the coil conductor 13 and the coil conductor 23, a characteristic impedance Z23 between the coil conductor 23 and the coil conductor 33, and a characteristic impedance Z31 between the coil conductor 33 and the coil conductor 13 can be prevented from collapsing due to the stray capacities between these coil conductors. In an example shown in FIG. 8, in the same turn, the line segment of the coil conductor 13 may be disposed at a distance L12 from the line segment of the coil conductor 23, the line segment of the coil conductor 23 may be disposed at a distance L23 from the line segment of the coil conductor 33, and the line segment of the coil conductor 33 may be disposed at a distance of L31 from the line segment of the coil conductor 13.

Since the coil conductor 13, the coil conductor 23, and the coil conductor 33 may be each formed in a spiral shape, a stray capacity may be generated also between the respective line segments of these coil conductors in each turn and the respective line segments of the coil conductors in a turn adjacent to said each turn. Thus, in order to maintain a balance of the characteristic impedance Z12, the characteristic impedance Z23, and the characteristic impedance Z31 so that these characteristic impedances are matched to characteristic impedances of a differential transmission circuit, it may be required to prevent a balance of the characteristic impedances between the coil conductors from collapsing due to an influence of a stray capacity between line segments respectively in different turns from each other. With reference to FIG. 8 and also to FIG. 9 and FIG. 10, a description is given of a stray capacity between line segments respectively in different turns from each other.

Figure 9:
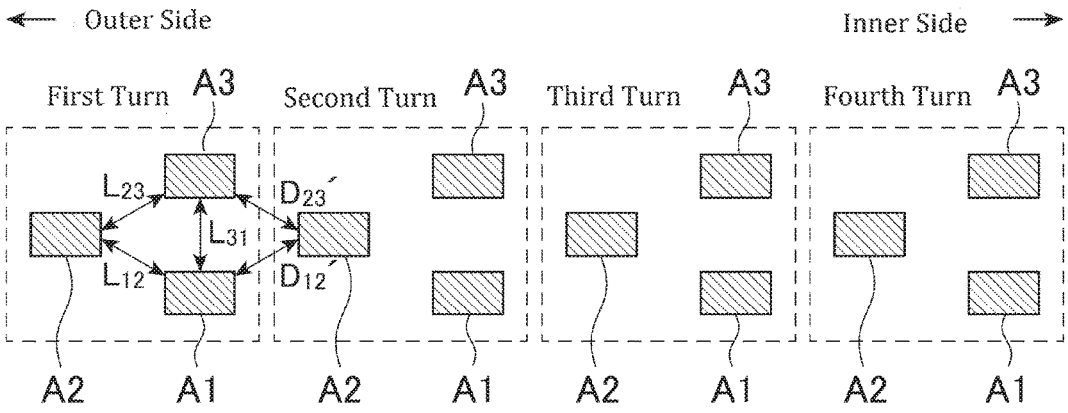
FIG. 9 is a schematic sectional view of a conventional common mode choke coil corresponding to FIG. 8.
Figure 10:
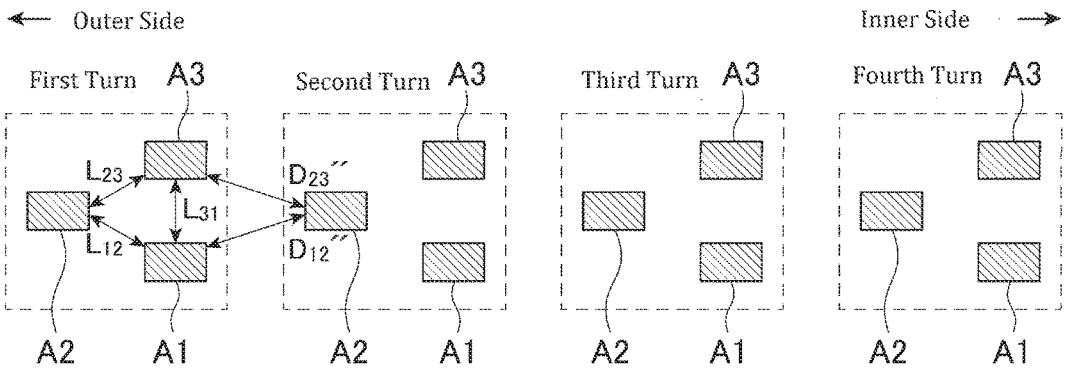
FIG. 10 is a schematic sectional view of the conventional common mode choke coil corresponding to FIG. 8.

FIG. 9 and FIG. 10 are schematic sectional views of a conventional common mode choke coil corresponding to FIG. 8. In a case where three spiral-shaped coil conductors are disposed in the conventional common mode choke coil, each of the coil conductors may be configured and disposed parallel with others of the coil conductors across all sections. When each of the three coil conductors (in FIG. 9 and FIG. 10, a coil conductor A1, a coil conductor A2, and a coil conductor A3) is disposed parallel with others of the coil conductors across an entire length thereof, in every turn, relative disposition of the coil conductors may be constant. That is, as shown in FIG. 9, disposition of the coil conductor A1, the coil conductor A2, and the coil conductor A3 may be the same in first to fourth turns. In this case, even if the three coil conductors are disposed so that stray capacities between the coil conductors in the same turn are equal to each other, due to a large stray capacity generated between them and the coil conductors in a turn adjacent to the same turn, the stray capacities between the coil conductors may be generated in a deviated manner. For example, in an example shown in FIG. 9, the coil conductor A3 in a first turn and the coil conductor A2 in a second turn are disposed adjacently to each other, and the coil conductor A1 in the first turn and the coil conductor A2 in the second turn are disposed adjacently to each other, so that a large stray capacity may be generated between these conductors disposed adjacently to each other. Due thereto, a balance of stray capacities between the coil conductors may collapse. For example, in the example of FIG. 9, a stray capacity between the coil conductor A1 in the first turn and the coil conductor A2 in the second turn and a stray capacity between the coil conductor A3 in the first turn and the coil conductor A2 in the second turn may be large, because of which a stray capacity generated between the coil conductor A1 and the coil conductor A2 and a stray capacity generated between the coil conductor A2 and the coil conductor A3 may become larger than a stray capacity generated between the coil conductor A1 and the coil conductor A3.

Meanwhile, in the common mode choke coil 1 according to the embodiment of the present invention, the coil conductor 23 may be disposed closely to the outer side in the first turn and disposed closely to the inner side in the second turn, and thus a distance D23 between the coil conductor 33 in the first turn and the coil conductor 23 in the second turn may be significantly larger than a distance D23' between the coil conductor A3 in the first turn and the coil conductor A2 in the second turn in the conventional common mode choke coil shown in FIG. 9. Similarly, in the common mode choke coil 1 according to the embodiment of the present invention, a distance D12 between the coil conductor 13 in the first turn and the coil conductor 23 in the second turn may be significantly larger than a distance D12' between the coil conductor A1 in the first turn and the coil conductor A2 in the second turn in the conventional common mode choke coil shown in FIG. 9. Accordingly, in the common mode choke coil 1 according to the embodiment of the present invention, a stray capacity between the coil conductor 13 in the first turn and the coil conductor 23 in the second turn and a stray capacity between the coil conductor 33 in the first turn and the coil conductor 23 in the second turn may be substantially negligible, and thus a balance of stray capacities generated between the coil conductors may be prevented from collapsing. That is, even in view of an influence of a stray capacity between the coil conductors respectively in turns adjacent to each other, the stray capacity C12 generated between the coil conductor 13 and the coil conductor 23, the stray capacity C23 generated between the coil conductor 23 and the coil conductor 33, and the stray capacity C31 generated between the coil conductor 33 and the coil conductor 13 can be set to be substantially equal to each other (that is, an equation C12≈C23≈C31 can be satisfied). Thus, according to the above-mentioned disposition of the coil conductor 13, the coil conductor 23, and the coil conductor 33, a balance of characteristic impedances between the coil conductors can also be maintained.

By increasing a spacing between turns adjacent to each other as shown in FIG. 10, even while maintaining the conventional disposition of the coil conductors shown in FIG. 9, there can be suppressed collapsing of a balance of stray capacities between the coil conductors, which occurs due to a stray capacity between them and the coil conductors in another turn. For example, in an example shown in FIG. 10, a spacing between a first turn and a second turn may be increased, so that correspondingly thereto, a distance D23" between a coil conductor A3 in the first turn and a coil conductor A2 in the second turn may be longer than the distance D23' shown in FIG. 9 corresponding thereto, and a distance D12" between a coil conductor A1 in the first turn and the coil conductor A2 in the second turn may be longer than the distance D12' shown in FIG. 9 corresponding thereto. However, increasing a spacing between turns adjacent to each other may result in an increase in dimensions of the common mode choke coil. Furthermore, also by reducing the number of turns of the coil conductors, while maintaining the conventional disposition of the coil conductors, there can be suppressed collapsing of a balance of stray capacities between the coil conductors, which occurs due to a stray capacity between them and the coil conductors in another turn. However, reducing the number of turns of the coil conductors may lower a common impedance, resulting in degradation of a common noise elimination characteristic of the common mode choke coil.

Meanwhile, in the common mode choke coil 1 according to one embodiment of the present invention shown in FIG. 8, when seen in a cross section cut along a plane including the coil axis CA, in the n-th turn, an order of arranging the coil conductor 13, the coil conductor 23, and the coil conductor 33 from the inner side in the radial direction thereof may be inverted from that in the n+1th turn, and thus even when a distance between the coil conductors respectively in turns adjacent to each other is reduced, a stray capacity generated between the coil conductors respectively in the turns adjacent to each other can be reduced. For example, as shown in FIG. 8, a distance D11 between the line segment of the coil conductor 13 in the first turn and the line segment thereof in the second turn and a distance D33 between the line segment of the coil conductor 33 in the first turn and the line segment thereof in the second turn can be made shorter than any of distances between the coil conductors in the same turn, i.e. the distance L12 between the coil conductor 13 and the coil conductor 23, the distance L23 between the coil conductor 23 and the coil conductor 33, and the distance L31 between the coil conductor 33 and the coil conductor 13.

As described in the foregoing, the common mode choke coil 1 according to the embodiment of the present invention can achieve a balance of characteristic impedances between the three coil conductors without degrading a common noise elimination characteristic. Furthermore, since there is achieved a balance of characteristic impedances between the three coil conductors, the characteristic impedances of the coil conductors can be matched to characteristic impedances of a differential transmission circuit.

Figure 11:
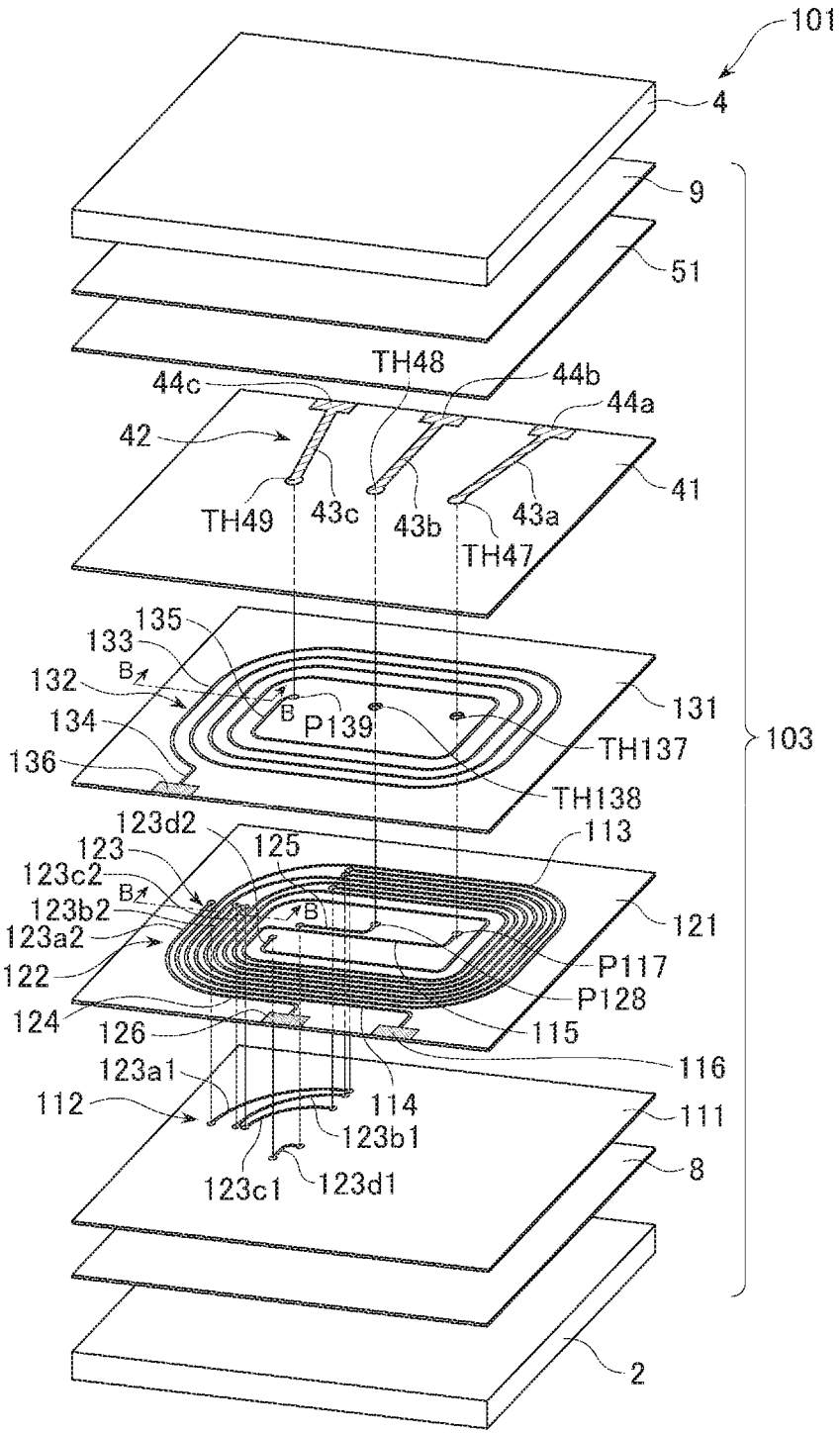
FIG. 11 is an exploded perspective view of a common mode choke coil according to another embodiment of the present invention.

Next, with reference to FIG. 11 to FIG. 16, a description is given of a common mode choke coil according to another embodiment of the present invention. FIG. 11 is an exploded perspective view of a common mode choke coil 101 according to another embodiment of the present invention. In the common mode choke coil 101 shown in FIG. 11, constituent components that are the same as or similar to those of the common mode choke coil 1 shown in FIG. 2 are denoted by reference characters similar to those in FIG. 2, and detailed descriptions thereof are omitted.

The common mode choke coil 101 shown in FIG. 11 may include a lower dummy insulation layer 2, an upper dummy insulation layer 4, and a laminated body 103 provided between the lower dummy insulation layer 2 and the upper dummy insulation layer 4. In one embodiment of the present invention, the laminated body 103 may include a lower magnetic layer 8 and an upper magnetic layer 9, and between these magnetic layers, there may be stacked a first insulation layer 111, a first conductor layer 112, a second insulation layer 121, a second conductor layer 122, a third insulation layer 131, a third conductor layer 132, an extraction electrode insulation layer 41, an extraction conductor layer 42, and a cover insulation layer 51.

As shown in the figure, the first insulation layer 111 may be formed on the lower magnetic layer 8. On the first insulation layer 111, the first conductor layer 112 may be formed. On the first conductor layer 112, the second insulation layer 121 may be formed. On said second insulation layer 121, the second conductor layer 122 may be formed. On said second conductor layer 122, the third insulation layer 131 may be formed. On said third insulation layer 131, the third conductor layer 132 may be formed.

Figure 12:
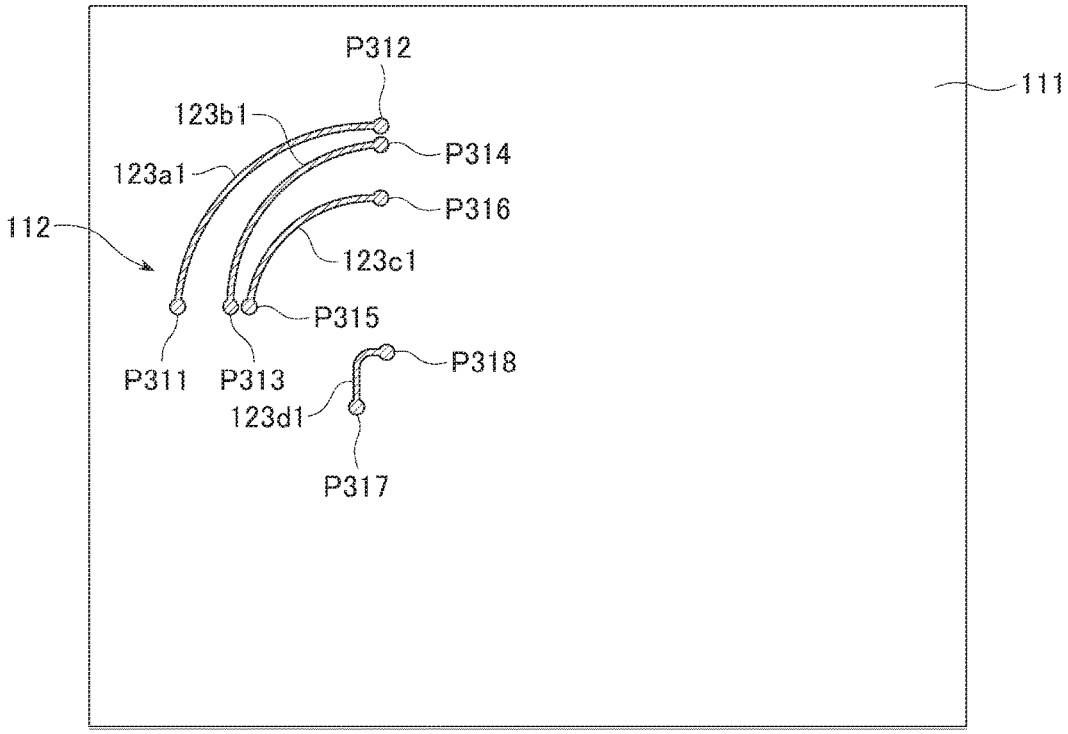
FIG. 12 is a plan view showing a first insulation layer and a first conductor layer formed on said first insulation layer, which are provided in the common mode choke coil in FIG. 11.
Figure 13:
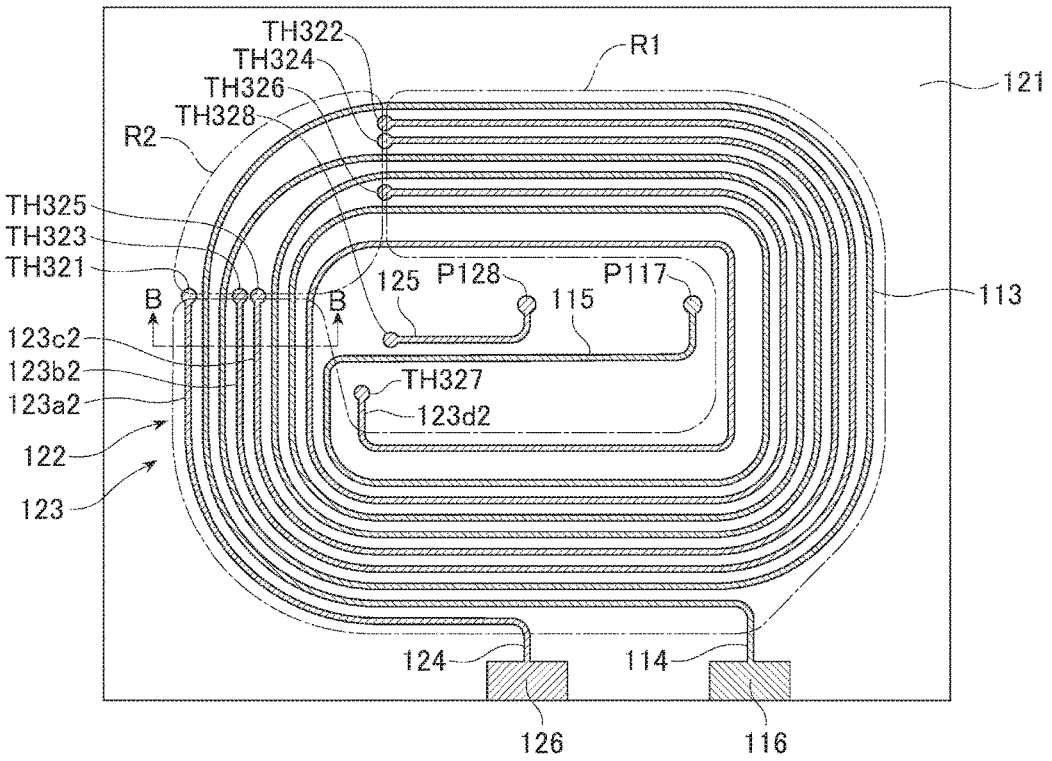
FIG. 13 is a plan view showing a second insulation layer and a second conductor layer formed on said second insulation layer, which are provided in the common mode choke coil in FIG. 11.

Next, with reference to FIG. 12 and FIG. 13, a description is given of the first conductor layer 112 and the second conductor layer 122. As shown in FIG. 13, the second conductor layer 122 may include a coil conductor 113, an extraction conductor 114 whose one end is connected to an outer side end portion of the coil conductor 113, an extraction conductor 115 whose one end is connected to an inner side end portion of the coil conductor 113, and an extraction electrode 116 connected to the extraction conductor 114. The extraction electrode 116 may be electrically connected to the terminal electrode 5*a*. The coil conductor 113 may be wound a plurality of turns around a coil axis CA, thus having a spiral shape. The second conductor layer 122 may further include a coil conductor 123*a*2, a coil conductor 123*b*2, a coil conductor 123*c*2, a coil conductor 123*d*2, an extraction conductor 124 whose one end is connected to an outer side end portion of the coil conductor 123*a*2, an extraction conductor 125 whose one end is connected to an inner side end portion of the coil conductor 123*d*2, and an extraction electrode 126 connected to the extraction conductor 124. The extraction electrode 126 may be electrically connected to the terminal electrode 6*a*.

Through the second insulation layer 121, there may be provided a plurality of through holes for connecting conductors constituting the second conductor layer 122 to conductors constituting the first conductor layer 112. Specifically, through the second insulation layer 121, a through hole TH321 may be formed at an inner side end potion of the coil conductor 123*a*2, a through hole TH322 may be formed at an outer side end portion of the coil conductor 123*b*2, a through hole TH323 may be formed at an inner side end portion of the coil conductor 123*b*2, a through hole TH324 may be formed at an outer side end portion of the coil conductor 123*c*2, a through hole TH325 may be formed at an inner side end portion of the coil conductor 123*c*2, a through hole TH326 may be formed at an outer side end portion of the coil conductor 123*d*2, and a through hole TH327 may be formed at an inner side end portion of the coil conductor 123*d*2. Furthermore, through the second insulation layer 121, a through hole TH328 may be formed at an outer side end portion of the extraction conductor 125.

As shown in FIG. 12, the first insulation layer 111 may include a coil conductor 123*a*1, a coil conductor 123*b*1, a coil conductor 123*c*1, and a coil conductor 123*d*1. Furthermore, through the first insulation layer 111, there may be provided a plurality of through holes for connecting these coil conductors to conductors of the second conductor layer 122 corresponding thereto. Specifically, on the first insulation layer 111, a pad P311 may be formed at an outer side end potion of the coil conductor 123*a*1, a pad P312 may be formed at an inner side end portion of the coil conductor 123*a*1, a pad 313 may be formed at an outer side end portion of the coil conductor 123*b*1, a pad 314 may be formed at an inner side end portion of the coil conductor 123*b*1, a pad P315 may be formed at an outer side end portion of the coil conductor 123*c*1, a pad P316 may be formed at an inner side end portion of the coil conductor 123*c*1, a pad P317 may be formed at an outer side end portion of the coil conductor 123*d*1, and a pad P318 may be formed at an inner side end portion of the coil conductor 123*d*1. In plan view of the common mode choke coil 101 as seen from an axial direction of the coil axis CA, the pads P311, P312, P313, P314, P315, P316, P317, and P318 may be formed at positions corresponding to the through holes TH321, TH322, TH323, TH324, TH325, TH326, TH327, and TH328, respectively. The through holes TH321, TH322, TH323, TH324, TH325, TH326, TH327, and TH328 may be formed by embedding a metal material such as Ag or the like in penetration holes formed through the second insulation layer 121.

The first insulation layer 111, the first conductor layer 112, the second insulation layer 121, and the second conductor layer 122, which are formed as described above, may be stacked so that the conductors constituting the first conductor layer 112 and the conductors constituting the second conductor layer 122 are brought into conduction via the pads P311, P312, P313, P314, P315, P316, P317, and P318 and the through holes TH321, TH322, TH323, TH324, TH325, TH326, TH327, and TH328. By stacking the first insulation layer 111, the first conductor layer 112, the second insulation layer 121, and the second conductor layer 122 as described above, the coil conductor 123 may be configured by the coil conductor 123*a*2, the coil conductor 123*a*1 connected to the coil conductor 123*a*2 via the through hole TH321 and the pad P311, the coil conductor 123*b*2 connected to the coil conductor 123*a*1 via the pad P312 and the through hole TH322, the coil conductor 123*b*1 connected to the coil conductor 123*b*2 via the through hole TH323 and the pad P313, the coil conductor 123*c*2 connected to the coil conductor 123*b*1 via the pad P314 and the through hole TH324, the coil conductor 123*c*1 connected to the coil conductor 123*c*2 via the through hole TH325 and the pad P315, the coil conductor 123*d*2 connected to the coil conductor 123*c*1 via the pad P316 and the through hole TH326, and the coil conductor 123*d*1 connected to the coil conductor 123*d*2 via the through hole TH327 and the pad P317.

Figure 14:
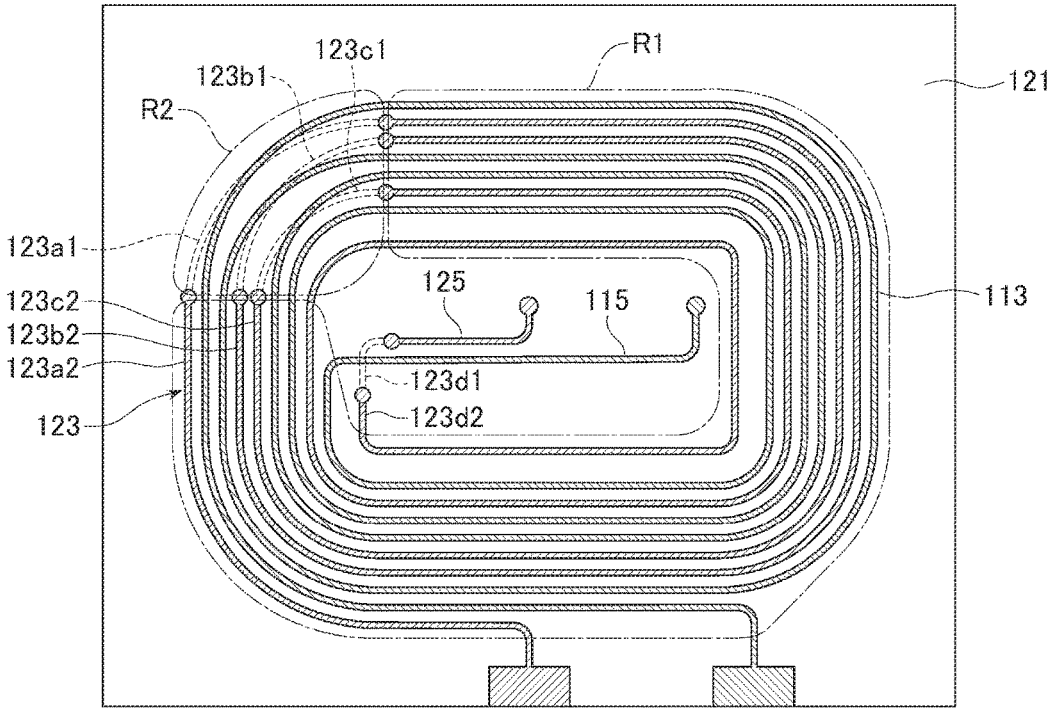
FIG. 14 is a schematic plan view showing a state where a second conductor layer 122 in FIG. 13 is superposed on a first conductor layer 112 in FIG. 12.

Furthermore, in a laminated body formed by stacking the first insulation layer 111, the first conductor layer 112, the second insulation layer 121, and the second conductor layer 122, in plan view as seen from the axial direction along a coil axis CA direction, the conductors constituting the first conductor layer 112 and the coil conductors constituting the second conductor layer 122 may be disposed as shown in FIG. 14. FIG. 14 is a schematic plan view showing, in order to further describe disposition of the conductors constituting the first conductor layer 112 and the conductors constituting the second conductor layer 122, a state where the second conductor layer 122 is superposed on the first conductor layer 112. In FIG. 14, the coil conductor 123*a*1, the coil conductor 123*b*1, the coil conductor 123*c*1, and the coil conductor 123*d*1 that constitute the first conductor layer 112 are shown by a broken line, and the conductors constituting the second conductor layer 122 are shown by a solid line.

As shown in FIG. 14, when the common mode choke coil 101 is seen in plan view from the axial direction along the coil axis CA, in a first region R1, a line segment of the coil conductor 113 and a line segment of the coil conductor 123 may be configured and disposed so as to extend parallel with each other. On the other hand, when the common mode choke coil 101 is seen in plan view, in a second region R2, the line segment of the coil conductor 113 and the line segment of the coil conductor 123 may be configured and disposed so as to cross over each other. When the common mode choke coil 101 is seen from the axial direction along the coil axis CA, disposition of the line segment of the coil conductor 113 and the line segment of the coil conductor 123 may be substantially similar to disposition of the coil conductor 13 and the coil conductor 23 shown in FIG. 7. That is, in a first turn of the line segment of the coil conductor 113 and the coil conductor 123, in the first region R1 up to a point before entering the second region R2, the coil conductor 123 may be disposed, in plan view, on an outer side relative to the coil conductor 113. In the second region R2, parallelism in disposition between the coil conductor 113 and the coil conductor 123 may collapse, and the coil conductor 113 and the coil conductor 123 may cross over each other, with the coil conductor 123 turning inwardly and the coil conductor 113 turning outwardly. In a similar manner, the coil conductor 113 and the coil conductor 123 may continue to extend to an inner side end portion of the extraction conductor 115 and an inner side end portion of the extraction conductor 125, respectively, while, as they make each turn, changing their passage lanes from an inner side lane to an outer side lane or from the outer side lane to the inner side lane.

Figure 15:
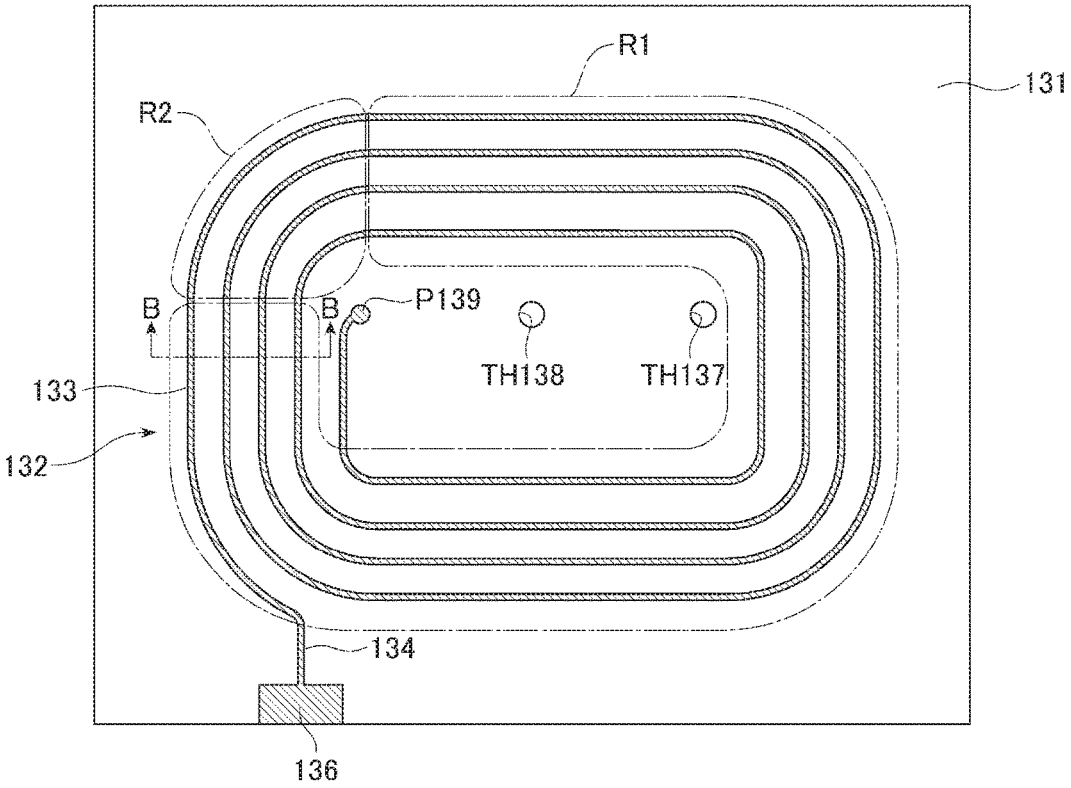
FIG. 15 is a plan view showing a third insulation layer and a third conductor layer formed on said third insulation layer, which are provided in the common mode choke coil shown in FIG. 11.

As mentioned above, on the second conductor layer 122, the third insulation layer 131 may be formed. On said third insulation layer 131, the third conductor layer 132 may be formed. With reference to FIG. 15, a description is given of a configuration of the third conductor layer 132. As shown in the figure, the third conductor layer 132 may include a spiral-shaped coil conductor 133, an extraction conductor 134 whose one end is connected to an outer side end portion of the coil conductor 133, an extraction conductor 135 whose one end is connected to an inner side end portion of the coil conductor 133, and an extraction electrode 136 connected to the extraction conductor 134. The extraction electrode 136 may be electrically connected to the terminal electrode 7*a*. The coil conductor 133 may be wound a plurality of turns around the coil axis CA, thus having a spiral shape. On the third conductor layer 132, the extraction electrode insulation layer 41 may be formed.

In order to connect an end portion of the extraction conductor 115 of the second conductor layer 122 to an end portion of the extraction conductor 43*a*, a pad P117 may be formed on the second insulation layer 121, a through hole TH137 may be formed through the third insulation layer 131, and a through hole TH47 may be formed through the extraction electrode insulation layer 41. The through holes TH137 and TH47 may be formed by embedding a metal material such as Ag or the like in penetration holes formed through the second insulation layer 121, the third insulation layer 131, and the extraction electrode insulation layer 41, respectively. In order to connect an end portion of the extraction conductor 125 of the second conductor layer 122 to an end portion of the extraction conductor 43*b*, a pad P128 may be formed on the second insulation layer 121, a through hole TH138 may be formed through the third insulation layer 131, and a through hole TH48 may be formed through the extraction electrode insulation layer 41. In order to connect an end portion of the extraction conductor 135 of the third conductor layer 132 to an end portion of the extraction conductor 43*c*, a pad P139 may be formed on the third insulation layer 131, and a through hole TH49 may be formed through the extraction electrode insulation layer 41. These through holes may be formed similarly to the through hole TH137.

By the above-mentioned configuration and disposition, in the common mode choke coil 101, three coils may be provided between the terminal electrodes 5*a*, 6*a*, and 7*a* and the terminal electrodes 5*b*, 6*b*, and 7*b*. That is, an outer side end of the coil conductor 113 may be electrically connected to the terminal electrode 5*a* via the extraction conductor 114 and the extraction electrode 116, and an inner side end of the coil conductor 113 may be electrically connected to the terminal electrode 5*b* via the extraction conductor 115, the pad P117, the through hole TH137, the through hole TH47, the extraction conductor 43*a*, and the extraction electrode 44*a*, so that a first coil including the coil conductor 113 may be configured between the terminal electrode 5*a* and the terminal electrode 5*b*. Furthermore, an outer side end of the coil conductor 123 may be electrically connected to the terminal electrode 6*a* via the extraction conductor 124 and the extraction electrode 126, and an inner side end of the coil conductor 123 may be electrically connected to the terminal electrode 6*b* via the extraction conductor 125, the pad P128, the through hole TH138, the through hole TH48, the extraction conductor 43*b*, and the extraction electrode 44*b*, so that a second coil including the coil conductor 123 may be configured between the terminal electrode 6*a* and the terminal electrode 6*b*. Moreover, an outer side end of the coil conductor 133 may be electrically connected to the terminal electrode 7*a* via the extraction conductor 134 and the extraction electrode 136, and an inner side end of the coil conductor 133 may be electrically connected to the terminal electrode 7*b* via the extraction conductor 135, the pad P139, the through hole TH49, the extraction conductor 43*c*, and the extraction electrode 44*c*, so that a third coil including the coil conductor 133 may be configured between the terminal electrode 7*a* and the terminal electrode 7*b*. These three coils may be each a planar coil formed on a plane.

The above-mentioned common mode choke coil 101 can be fabricated by a method similar to the method for fabricating the common mode choke coil 1.

Figure 16:
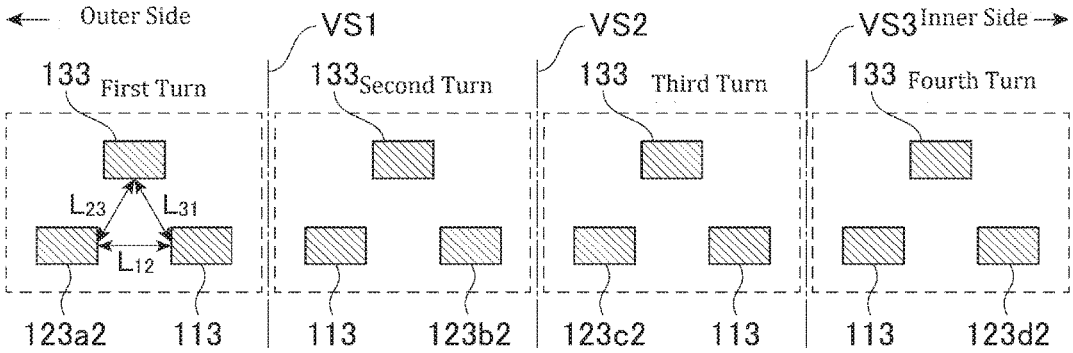
FIG. 16 is a sectional view schematically showing the first conductor layer, the second conductor layer, and the third conductor layer in a cross section of the common mode choke coil in FIG. 11 cut along a B-B line.

Next, with reference to FIG. 16, a further description is given of disposition of the coil conductor 113, the coil conductor 123, and the coil conductor 133. FIG. 16 is a sectional view schematically showing a cross section (for example, a cross section cut along a B-B line shown in FIG. 13 and FIG. 15) of the common mode choke coil 101 cut along a plane including the coil axis CA.

As described with reference to FIG. 14, in the first turn, at a point before passing through the second region R2, the coil conductor 123 (the coil conductor 123*a*2) may be disposed on an outer side relative to the coil conductor 113. In a second turn, this disposition is reversed, i.e., the coil conductor 113 may be disposed on an outer side relative to the coil conductor 123 (the coil conductor 123*b*2). The coil conductor 133 may be disposed between the coil conductor 113 and the coil conductor 123. In other words, when seen in a cross section cut along a plane including the coil axis CA, in an n-th turn, an order of arranging the coil conductor 113, the coil conductor 123, and the coil conductor 133 from an inner side in a radial direction thereof may be inverted from that in an n+1th turn. That is, in the first turn, from the inner side in the radial direction, the coil conductors may be arranged in an order of the coil conductor 113, the coil conductor 133, and the coil conductor 123, while in the second turn, conversely thereto, the coil conductors may be arranged in an order of the coil conductor 123, the coil conductor 133, and the coil conductor 113. This disposition may be reversed in a third turn and further reversed therefrom in a fourth turn. Thus, the disposition of the coil conductors in the first turn and the disposition of the coil conductors in the second turn may be plane-symmetrical to each other with respect to a virtual plane VS1 passing between the first turn and the second turn. Similarly, the disposition of the coil conductors in the second turn and the disposition of the coil conductors in the third turn may be plane-symmetrical to each other with respect to a virtual plane VS2 passing between the second turn and the third turn, and the disposition thereof in the third turn and the disposition thereof in the fourth turn may be plane-symmetrical to each other with respect to a virtual plane VS3 passing between the third turn and the fourth turn.

In one embodiment of the present invention, the coil conductor 113, the coil conductor 123, and the coil conductor 133 may be disposed in the first region R1 so that a stray capacity generated between the coil conductor 113 and the coil conductor 123, a stray capacity generated between the coil conductor 123 and the coil conductor 133, and a stray capacity generated between the coil conductor 133 and the coil conductor 113 are equal to each other.

In the above-mentioned common mode choke coil 101, when seen in a cross section cut along a plane including the coil axis CA, in the n-th turn, an order of arranging the coil conductor 113, the coil conductor 133, and the coil conductor 123 from the inner side in the radial direction thereof may be inverted from that in the n+1th turn, and thus, in turns adjacent to each other, the coil conductors of the same type can be disposed so that a distance between them is smallest among distances between the coil conductors. Thus, compared with the conventional common mode choke coil in which, in turns adjacent to each other, the coil conductors of different types are disposed so that a distance between them is smallest among distances between the coil conductors, there can be suppressed a deviation in stray capacities between the coil conductors, which occurs due to a stray capacity generated between the coil conductors respectively in the turns adjacent to each other.

Furthermore, in the common mode choke coil 101, when seen in a cross section cut along a plane including the coil axis CA, in the n-th turn, an order of arranging the coil conductor 113, the coil conductor 133, and the coil conductor 123 from the inner side in the radial direction thereof may be inverted from that in the n+1th turn, and thus even when a distance between the coil conductors respectively in turns adjacent to each other is reduced, a stray capacity generated between the coil conductors respectively in turns adjacent to each other can be reduced. Thus, in the common mode choke coil 101, a balance of characteristic impedances between the three coil conductors can be achieved without degrading a common noise elimination characteristic.

Figure 17:
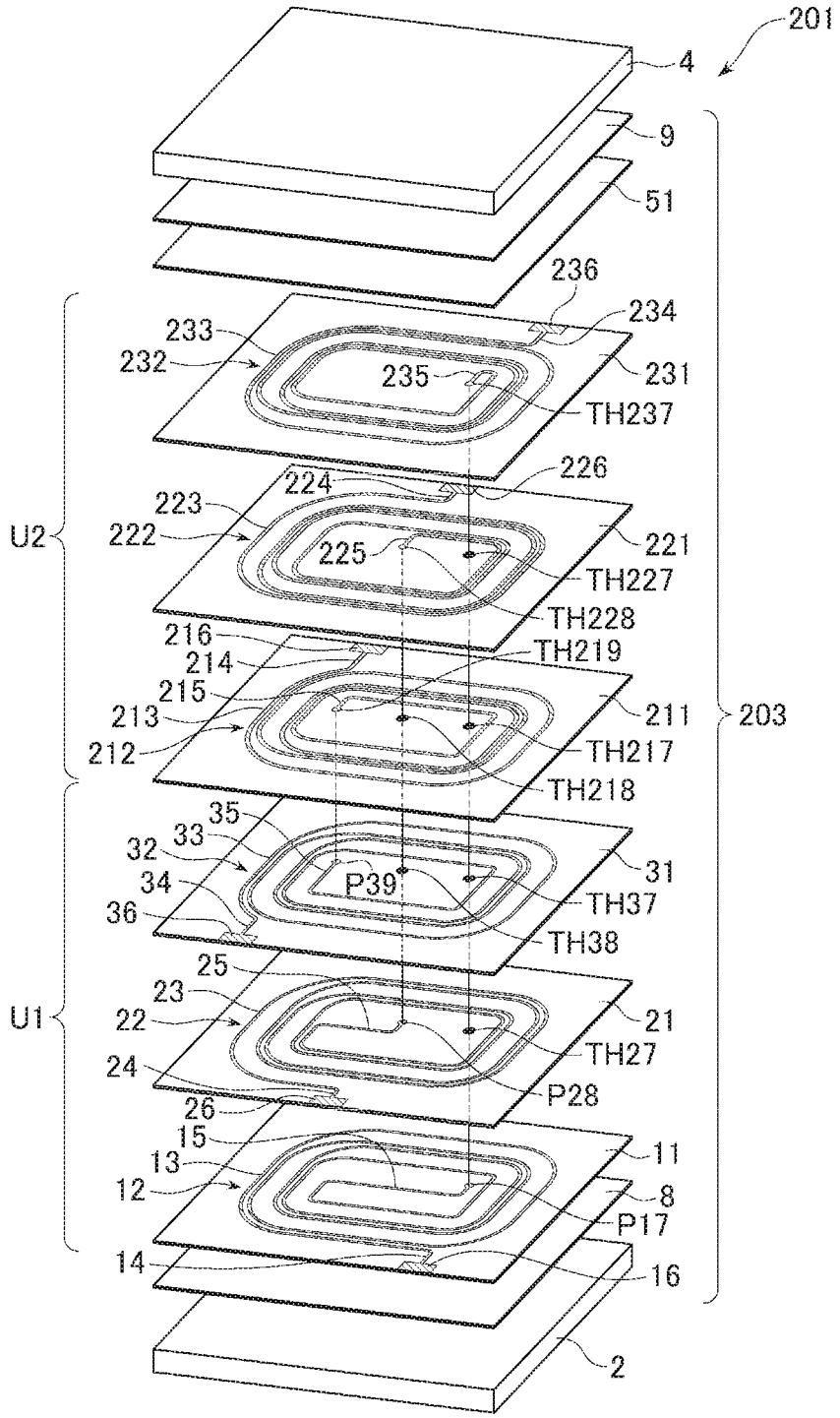
FIG. 17 is an exploded perspective view of a common mode choke coil according to still another embodiment of the present invention.
Figure 18:
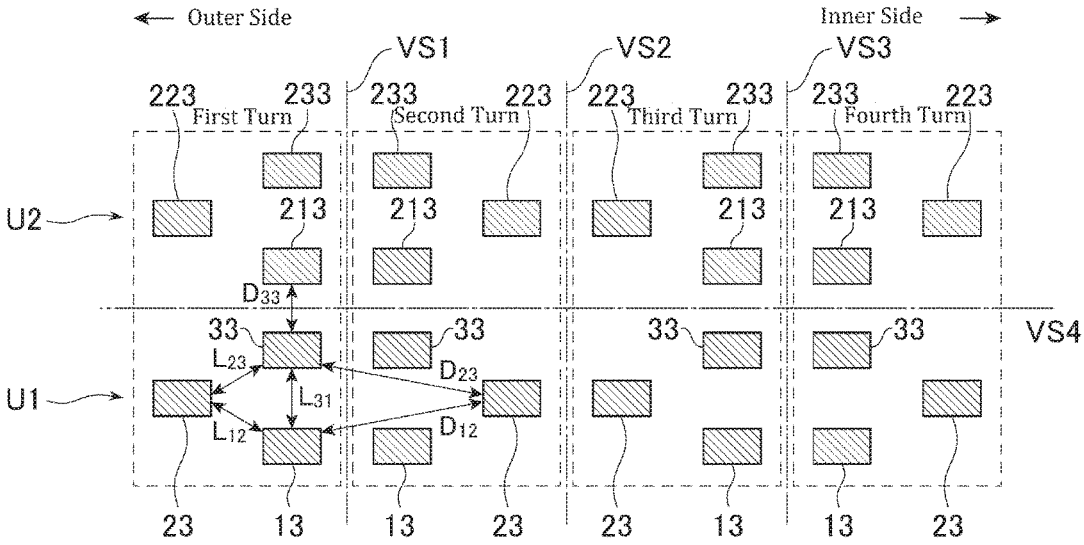
FIG. 18 is a sectional view schematically showing a cross section obtained by cutting the common mode choke coil in FIG. 17.

Next, with reference to FIG. 17 and FIG. 18, a description is given of a common mode choke coil according to still another embodiment of the present invention. FIG. 17 is an exploded perspective view of a common mode choke coil 201 according to still another embodiment of the present invention. In the common mode choke coil 201 shown in FIG. 17, constituent components that are the same as or similar to those of the common mode choke coil 1 shown in FIG. 2 are denoted by reference characters similar to those in FIG. 2, and detailed descriptions thereof are omitted.

The common mode choke coil 201 shown in FIG. 17 may include a lower dummy insulation layer 2, an upper dummy insulation layer 4, and a laminated body 203 provided between the lower dummy insulation layer 2 and the upper dummy insulation layer 4. In one embodiment of the present invention, the laminated body 203 may include a lower magnetic layer 8, an upper magnetic layer 9, a first coil unit U1, a second coil unit U2, and a cover insulation layer 51.

As shown in the figure, the first coil unit U1 may be formed on the lower magnetic layer 8. The first coil unit U1 may include a first insulation layer 11, a first conductor layer 12, a second insulation layer 21, a second conductor layer 22, a third insulation layer 31, and a third conductor layer 32. The first insulation layer 11, the first conductor layer 12, the second insulation layer 21, the second conductor layer 22, the third insulation layer 31, and the third conductor layer 32 may be configured similarly to those of the common mode choke coil 1 shown in FIG. 2.

The second coil unit U2 may be formed on the first coil unit U1. The second coil unit U2 may include, in order from below, a fourth insulation layer 211, a fourth conductor layer 212, a fifth insulation layer 221, a fifth conductor layer 222, a sixth insulation layer 231, and a sixth conductor layer 232. The fourth insulation layer 211 and the fourth conductor layer 212 formed thereon may be configured similarly to the third insulation layer 31 and the third conductor layer 32 formed thereon, respectively, the fifth insulation layer 221 and the fifth conductor layer 222 formed thereon may be configured similarly to the second insulation layer 21 and the second conductor layer 22 formed thereon, respectively, and the sixth insulation layer 231 and the sixth conductor layer 232 formed thereon may be configured similarly to the first insulation layer 11 and the first conductor layer 12 formed thereon, respectively. More specifically, the fourth conductor layer 212 may include a spiral-shaped coil conductor 213, an extraction conductor 214 whose one end is connected to an outer side end portion of the coil conductor 213, an extraction conductor 215 whose one end is connected to an inner side end portion of the coil conductor 213, and an extraction electrode 216 connected to the extraction conductor 214. The extraction electrode 216 may be electrically connected to the terminal electrode 7*a*. Furthermore, the fifth conductor layer 222 may include a spiral-shaped coil conductor 223, an extraction conductor 224 whose one end is connected to an outer side end portion of the coil conductor 223, an extraction conductor 225 whose one end is connected to an inner side end portion of the coil conductor 223, and an extraction electrode 226 connected to the extraction conductor 224. The extraction electrode 226 may be electrically connected to the terminal electrode 6*b*. Furthermore, the sixth conductor layer 232 may include a spiral-shaped coil conductor 233, an extraction conductor 234 whose one end is connected to an outer side end portion of the coil conductor 233, an extraction conductor 235 whose one end is connected to an inner side end portion of the coil conductor 233, and an extraction electrode 236 connected to the extraction conductor 234. The extraction electrode 236 may be electrically connected to the terminal electrode 5*b*. In plan view, the coil conductor 213 may be formed in the same shape as that of the coil conductor 33 and disposed at such a position as to overlap with the coil conductor 33. Furthermore, in plan view, the coil conductor 223 may be formed in the same shape as that of the coil conductor 23 and disposed at such a position as to overlap with the coil conductor 23. Furthermore, in plan view, the coil conductor 233 may be formed in the same shape as that of the coil conductor 13 and disposed at such a position as to overlap with the coil conductor 13.

A through hole TH217, a through hole TH218, and a through hole TH219 may be formed through the fourth insulation layer 211, a through hole TH227 and a through hole TH228 may be formed through the fifth insulation layer 221, and a through hole TH237 may be formed through the sixth insulation layer 231. These through holes may be formed similarly to the through hole TH27.

By the above-mentioned configuration and disposition, in the common mode choke coil 201, three coils may be provided between the terminal electrodes 5*a*, 5*a*, and 7*a* and the terminal electrodes 5*b*, 6*b*, and 7*b*. That is, between the terminal electrode 5*a* and the terminal electrode 5*b*, there is formed a first coil composed of the extraction electrode 16, the extraction conductor 14, the coil conductor 13, the extraction conductor 15, the pad P17, the through holes TH27, TH37, TH217, TH227, and TH237, the extraction conductor 235, the coil conductor 233, the extraction conductor 234, and the extraction electrode 236. Furthermore, between the terminal electrode 6*a* and the terminal electrode 6*b*, there is formed a second coil composed of the extraction electrode 26, the extraction conductor 24, the coil conductor 23, the extraction conductor 25, the pad P28, the through holes TH38, TH218, and TH228, the extraction conductor 225, the coil conductor 223, the extraction conductor 224, and the extraction electrode 226. Furthermore, between the terminal electrode 7*a* and the terminal electrode 7*b*, there is formed a third coil composed of the extraction electrode 36, the extraction conductor 34, the coil conductor 33, the extraction conductor 35, the pad P39, the through hole TH219, the extraction conductor 215, the coil conductor 213, the extraction conductor 214, and the extraction electrode 216.

The above-mentioned common mode choke coil 201 can be fabricated by a method similar to the method for fabricating the common mode choke coil 1.

Next, with reference to FIG. 18, a further description is given of disposition of the coil conductor 13, the coil conductor 23, the coil conductor 33, the coil conductor 213, the coil conductor 223, and the coil conductor 233. FIG. 18 is a sectional view schematically showing a cross section (for example, a cross section cut along a plane corresponding to the A-A line shown in FIG. 3) of the common mode choke coil 201 cut, in a first region R1, along a plane including a coil axis CA. Disposition of the coil conductors in the coil unit U1 may be the same as disposition of the coil conductors shown in FIG. 8. That is, when seen in a cross section cut along a plane including the coil axis CA, in an n-th turn, an order of arranging the coil conductor 13, the coil conductor 23, and the coil conductor 33 from an inner side in a radial direction thereof may be inverted from that in an n+1th turn. For example, in a first turn, from the inner side in the radial direction, the coil conductors may be arranged in an order of the coil conductor 13 (or the coil conductor 33) and the coil conductor 23, while in a second turn, conversely thereto, the coil conductors may be arranged in an order of the coil conductor 23 and the coil conductor 13 (or the coil conductor 33). Furthermore, also in the coil unit U2, similarly, when seen in a cross section cut along a plane including the coil axis CA, in the n-th turn, an order of arranging the coil conductor 213, the coil conductor 223, and the coil conductor 233 from an inner side in a radial direction thereof may be inverted from that in the n+1th turn. For example, in a first turn, from the inner side in the radial direction, the coil conductors may be arranged in an order of the coil conductor 213 (or the coil conductor 233) and the coil conductor 223, while in a second turn, conversely thereto, the coil conductors may be arranged in an order of the coil conductor 223 and the coil conductor 213 (or the coil conductor 233).

In the above-mentioned common mode choke coil 201, when seen in a cross section cut along a plane including the coil axis CA, in the n-th turn, an order of arranging the coil conductor 213, the coil conductor 223, and the coil conductor 233 from the inner side in the radial direction thereof may be inverted from that in the n+1th turn, and thus, in turns adjacent to each other, the coil conductors of the same type can be disposed so that a distance between them is smallest among distances between the coil conductors. Thus, compared with the conventional common mode choke coil in which, in turns adjacent to each other, the coil conductors of different types are disposed so that a distance between them is smallest among distances between the coil conductors, there can be suppressed a deviation in stray capacities between the coil conductors, which occurs due to a stray capacity generated between the coil conductors respectively in the turns adjacent to each other.

Furthermore, in the common mode choke coil 201 according to one embodiment of the present invention, when seen in a cross section cut along a plane including the coil axis CA, disposition of the coil conductors included in the coil unit U1 and disposition of the coil conductors included in the coil unit U2 may be plane-symmetrical to each other with respect to a virtual plane VS4 passing between the coil unit U1 and the coil unit U2. That is, the coil conductor 213 of the coil unit U2 may be disposed at a position plane-symmetrical with respect to the virtual plane VS4 to, among the coil conductors constituting the coil unit U1, the coil conductor 33 to which said coil conductor 213 is electrically connected. The coil conductor 223 of the coil unit U2 may be disposed at a position plane-symmetrical with respect to the virtual plane VS4 to, among the coil conductors constituting the coil unit U1, the coil conductor 23 to which said coil conductor 223 is electrically connected. The coil conductor 233 of the coil unit U2 may be disposed at a position plane-symmetrical with respect to the virtual plane VS4 to, among the coil conductors constituting the coil unit U1, the coil conductor 13 to which said coil conductor 233 is electrically connected. The virtual plane VS4 may be a virtual plane that is provided between the coil unit U1 and the coil unit U2 and extends in a direction perpendicular to the coil axis CA (or extends in a direction parallel with the insulation layers such as the insulation layer 11 and so on). In other words, in the common mode choke coil 201 according to one embodiment of the present invention, when seen in a cross section cut along a plane including the coil axis CA, an order of arranging the coil conductors constituting a first coil conductor (namely, the coil conductor 13 and the coil conductor 233), the coil conductors constituting a second coil conductor (namely, the coil conductor 23 and the coil conductor 223), and the coil conductors constituting a third coil conductor (namely, the coil conductor 33 and the coil conductor 213) along the coil axis CA may be inverted between the coil unit U1 and the coil unit U2. That is, in the coil unit U1, from a lower side in the coil axis CA direction, the coil conductor 13 of the first coil conductor, the coil conductor 23 of the second coil conductor, and the coil conductor 33 of the third coil conductor may be arranged in this order, while in the coil unit U2, conversely thereto, from a lower side in said coil axis CA direction, the coil conductor 213 of the third coil conductor, the coil conductor 223 of the second coil conductor, and the coil conductor 233 of the first coil conductor may be arranged in this order.

As described above, an order of arranging the coil conductors constituting the first coil conductor, the coil conductors constituting the second coil conductor, and the coil conductors constituting the third coil conductor in the coil axis CA direction is inverted between the coil unit U1 and the coil unit U2, and thus in the coil units adjacent to each other in a stacking direction thereof, the coil conductors of the same type can be disposed so that a distance between them is smallest among distances between the coil conductors. Thus, there can be suppressed a deviation in stray capacities between the coil conductors, which occurs due to a stray capacity generated between the coil units adjacent to each other in a stacking direction thereof. Furthermore, even when a distance between the coil conductors respectively in the coil unit U1 and the coil unit U2 adjacent to each other in the coil axis CA direction (for example, a distance D33 between the coil conductor 33 and the coil conductor 213) is reduced, a stray capacity generated between the coil conductors respectively in the coil units adjacent to each other in the coil axis CA direction can be reduced.

It may also be possible that, in addition to the coil unit U1 and the coil unit U2, still another coil unit is additionally provided. For example, an additional coil unit configured similarly to the coil unit U1 can be prepared and disposed adjacently to the coil unit U2 in the coil axis CA direction. In this case, the additional coil unit may be provided adjacently to the coil unit U2 on an opposite side to the coil unit 1.

Various modifications can be made to the coil units stacked in the coil axis CA direction. For example, it may also be possible that a plurality of coil units are configured to include the first insulation layer 111, the first conductor layer 112, the second insulation layer 121, the second conductor layer 122, the third insulation layer 131, and the third conductor layer 132 in the embodiment shown in FIG. 11. The plurality of coil units configured as described above may be disposed adjacently to each other in the coil axis CA direction. Furthermore, the plurality of coil units may be disposed so that disposition of the coil conductors included in each of the coil units are plane-symmetrical with respect to a virtual plane passing between said plurality of coil units.

As described in the foregoing, in the common mode choke coils according to the various embodiments of the present invention, a balance of characteristic impedances between the three coil conductors can be achieved without degrading a common noise elimination characteristic. Furthermore, since there is achieved a balance of characteristic impedances between the three coil conductors, the characteristic impedances of the coil conductors can be matched to characteristic impedances of a differential transmission circuit.

The dimensions, materials, and disposition of the various constituent components described in this specification are not limited to those explicitly described in the embodiments, and the various constituent components can be modified to have arbitrary dimensions, materials, and disposition within the scope of the present invention. Furthermore, constituent components not explicitly described in this specification can also be added to the embodiments described, and some of the constituent components described in the embodiments can also be omitted.

What is claimed is:

1. A common mode choke coil comprising:

a first coil conductor provided on a first coil forming surface in a first insulator and wound around a coil axis;

a second coil conductor provided on a second coil forming surface in the first insulator and wound around the coil axis; and a third coil conductor provided on a third coil forming surface in the first insulator and wound around the coil axis, wherein the common mode choke coil is divided into a first region and a second region in plan view as seen from an axial direction along the coil axis, the first region extending in a circumferential direction around the coil axis, the second region adjoining both ends of the first region in the circumferential direction and extending in the circumferential direction, in the first region, each of the first coil conductor, the second coil conductor, and the third coil conductor extends parallel with the other coil conductors, and in the second region, each of the first coil conductor, the second coil conductor, and the third coil conductor crosses at least one of the other coil conductors in plan view as seen from the axial direction, and crosses none of the other coil conductors as seen in a section cut along a plane including the coil axis.

2. The common mode choke coil according to claim 1, wherein the first coil conductor and the second coil conductor, the second coil conductor and the third coil conductor, or the third coil conductor and the first coil conductor are formed in the same shape in plan view as seen from the axial direction.

3. The common mode choke coil according to claim 1, wherein in the first region, a line segment of the first coil conductor in the n+1th turn, a line segment of the second coil conductor in the n+1th turn, and a line segment of the third coil conductor in the n+1th turn are plane-symmetrical to a line segment of the first coil conductor in the n-th turn, a line segment of the second coil conductor in the n-th turn, and a line segment of the third coil conductor in the n-th turn, respectively, with respect to a first virtual plane extending through a midpoint between the line segment of the first coil conductor in the n-th turn and the line segment of the first coil conductor in the n+1th turn and extending parallel with the coil axis, wherein n is such a positive real number that n+1 exceeds none of a number of turns of the first coil conductor, a number of turns of the second coil conductor, and a number of turns of the third coil conductor.

4. The common mode choke coil according to claim 1, wherein in the first region, a stray capacity generated between a line segment of the first coil conductor in the n-th turn and a line segment of the second coil conductor in the n-th turn, a stray capacity generated between the line segment of the first coil conductor in the n-th turn and a line segment of the third coil conductor in the n-th turn, and a stray capacity generated between the line segment of the second coil conductor in the n-th turn and the line segment of the third coil conductor in the n-th turn are equal to each other, wherein n is such a positive real number that n+1 exceeds none of a number of turns of the first coil conductor, a number of turns of the second coil conductor, and a number of turns of the third coil conductor.

5. The common mode choke coil according to claim 1, wherein the first coil forming surface, the second coil forming surface, and the third coil forming surface are separate from each other.

6. The common mode choke coil according to claim 1, wherein the first coil forming surface and the second coil forming surface, the second coil forming surface and the third coil forming surface, or the third coil forming surface and the first coil forming surface are the same.

7. The common mode choke coil according to claim 1, wherein all of a line segment of the first coil conductor in the n-th turn, a line segment of the second coil conductor in the n-th turn, and a line segment of the third coil conductor in the n-th turn are longer in the first region than in the second region, wherein n is such a positive real number that n+1 exceeds none of a number of turns of the first coil conductor, a number of turns of the second coil conductor, and a number of turns of the third coil conductor.

8. The common mode choke coil according to claim 1, wherein a distance between an innermost one of respective line segments of the first coil conductor, the second coil conductor, and the third coil conductor in the n-th turn and an outermost one of respective line segments of the first coil conductor, the second coil conductor, and the third coil conductor in the n+1th turn is shorter than any of a distance in the first region between the first coil conductor and the second coil conductor, a distance in the first region between the second coil conductor and the third coil conductor, and a distance in the first region between the third coil conductor and the first coil conductor, wherein n is such a positive real number that n+1 exceeds none of a number of turns of the first coil conductor, a number of turns of the second coil conductor, and a number of turns of the third coil conductor.

9. The common mode choke coil according to claim 1, further comprising: a first coil unit including the first coil conductor, the second coil conductor, and the third coil conductor; and a second coil unit provided opposite to the first coil unit, wherein the second coil unit includes:

a fourth coil conductor provided on a fourth coil forming surface in a second insulator and wound around the coil axis;

a fifth coil conductor provided on a fifth coil forming surface in the second insulator and wound around the coil axis; and a sixth coil conductor provided on a sixth coil forming surface in the second insulator and wound around the coil axis, wherein the sixth coil conductor is electrically connected to the first coil conductor, the fifth coil conductor is electrically connected to the second coil conductor, the fourth coil conductor is electrically connected to the third coil conductor, and the second coil unit is configured so that, with respect to a second virtual plane extending between the first coil unit and the second coil unit perpendicularly to the coil axis, the sixth coil conductor is plane-symmetrical to the first coil conductor, the fifth coil conductor is plane-symmetrical to the second coil conductor, and the fourth coil conductor is plane-symmetrical to the third coil conductor.

10. The common mode choke coil according to claim 9, wherein a distance between one of the first coil conductor, the second coil conductor, and the third coil conductor that is disposed closest to the second coil unit, and one of the fourth coil conductor, the fifth coil conductor, and the sixth coil conductor that is disposed closest to the first coil unit is shorter than any of a distance in the first region between the first coil conductor and the second coil conductor, a distance in the first region between the second coil conductor and the third coil conductor, and a distance in the first region between the third coil conductor and the first coil conductor.

11. The common mode choke coil according to claim 1, further comprising:

a first terminal electrode;

a second terminal electrode;

a third terminal electrode;

a fourth terminal electrode;

a fifth terminal electrode; and a sixth terminal electrode, wherein the first coil conductor is disposed between the first terminal electrode and the second terminal electrode, the second coil conductor is disposed between the third terminal electrode and the fourth terminal electrode, and the third coil conductor is disposed between the fifth terminal electrode and the sixth terminal electrode.

12. The common mode choke coil according to claim 9, further comprising:

a first terminal electrode;

a second terminal electrode;

a third terminal electrode;

a fourth terminal electrode;

a fifth terminal electrode; and a sixth terminal electrode, wherein the first coil conductor and the sixth coil conductor are disposed between the first terminal electrode and the second terminal electrode, the second coil conductor and the fifth coil conductor are disposed between the third terminal electrode and the fourth terminal electrode, and the third coil conductor and the fourth coil conductor are disposed between the fifth terminal electrode and the sixth terminal electrode.

13. The common mode choke coil according to claim 1, wherein the first insulator is made of a non-magnetic material.

14. The common mode choke coil according to claim 9, wherein the second insulator is made of a non-magnetic material.

15. The common mode choke coil according to claim 13, wherein the first insulator is made of a resin or a dielectric ceramic.

16. The common mode choke coil according to claim 14, wherein the second insulator is made of a resin or a dielectric ceramic.

17. The common mode choke coil according to claim 1, further comprising:

an insulating upper dummy layer provided above the first insulator; and an insulating lower dummy layer provided below the first insulator, wherein the upper dummy layer and the lower dummy layer are each made of a magnetic material.

18. The common mode choke coil according to claim 9, further comprising:

an insulating upper dummy layer provided above the first insulator; and an insulating lower dummy layer provided below the second insulator, wherein the upper dummy layer and the lower dummy layer are each made of a magnetic material.

19. The common mode choke coil according to claim 17, wherein the magnetic material is Ni-Zu-Cu-based ferrite.

20. The common mode choke coil according to claim 18, wherein the magnetic material is Ni-Zu-Cu-based ferrite.

* * * * *